US012779293B2

(12) United States Patent
Carr

(10) Patent No.: US 12,779,293 B2
(45) **Date of Patent: *Nov. 3, 2026**

(54) GOLF CLUB HEAD WITH IMPROVED STRIKING FACE

(71) Applicant: Acushnet Company, Fairhaven, MA (US)

(72) Inventor: Kyle A. Carr, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 284 days.

This patent is subject to a terminal disclaimer.

(21) Appl. No.: 18/622,972

(22) Filed: Mar. 31, 2024

(65) Prior Publication Data

US 2024/0238652 A1 Jul. 18, 2024

Related U.S. Application Data

(63) Continuation of application No. 17/959,197, filed on Oct. 3, 2022, now Pat. No. 11,969,630, which is a continuation-in-part of application No. 17/471,040, filed on Sep. 9, 2021, now Pat. No. 12,582,880.

(51) Int. Cl.
*A63B 53/04* (2015.01)

(52) U.S. Cl.
CPC ..... *A63B 53/0458* (2020.08); *A63B 53/0408* (2020.08); *A63B 53/0466* (2013.01)

(58) Field of Classification Search
CPC ..... A63B 53/0458; A63B 53/0408; A63B 2209/00; A63B 53/042; A63B 53/0454; A63B 53/0475; A63B 60/54
See application file for complete search history.

(56) References Cited

U.S. PATENT DOCUMENTS

| | | | | |
|---|---|---|---|---|
| 4,432,549 A | | 2/1984 | Zebelean | |
| 4,928,972 A | * | 5/1990 | Nakanishi | A63B 53/047 473/332 |
| 5,261,664 A | * | 11/1993 | Anderson | A63B 53/0466 473/345 |
| 5,299,807 A | * | 4/1994 | Hutin | A63B 53/04 473/329 |
| 5,467,983 A | * | 11/1995 | Chen | A63B 53/0466 473/346 |
| 5,505,453 A | * | 4/1996 | Mack | A63B 53/0466 473/329 |
| 5,509,660 A | * | 4/1996 | Elmer | A63B 53/0466 473/330 |
| 5,524,331 A | * | 6/1996 | Pond | A63B 60/00 29/527.4 |

(Continued)

FOREIGN PATENT DOCUMENTS

| | | |
|---|---|---|
| JP | 2002-239040 | 8/2002 |
| JP | 2020-518372 A | 6/2020 |

*Primary Examiner* — William M Pierce
(74) *Attorney, Agent, or Firm* — Ryan A. Reis

(57) ABSTRACT

A golf club head with improved striking face is disclosed. More specifically, the present invention relates to a golf club head comprising multiple materials, wherein a gasket is placed in between a body portion of the golf club head and a face insert of the golf club head. The gasket being made of a different material than the body portion or the face insert. The construction providing reduced stress in the face insert, manipulation of performance characteristics, and improved sound and feel.

18 Claims, 22 Drawing Sheets

(56) References Cited

U.S. PATENT DOCUMENTS 5,720,673 A * 2/1998 Anderson ..... A63B 60/00 473/324
5,743,813 A * 4/1998 Chen ..... A63B 53/0466 473/345
5,816,936 A * 10/1998 Aizawa ..... A63B 53/047 473/335
5,842,934 A * 12/1998 Ezaki ..... A63B 60/00 473/349
5,967,903 A * 10/1999 Cheng ..... A63B 53/047 473/349
6,117,023 A * 9/2000 Onuki ..... A63B 53/04 473/324
6,364,789 B1 * 4/2002 Kosmatka ..... A63B 53/0466 473/345
6,595,057 B2 7/2003 Bissonnette
6,669,577 B1 * 12/2003 Hocknell ..... A63B 53/0466 473/345
6,679,786 B2 1/2004 McCabe
6,743,117 B2 * 6/2004 Gilbert ..... A63B 53/047 473/332
6,800,038 B2 10/2004 Willett
6,824,475 B2 11/2004 Burnett
6,863,626 B2 3/2005 Evans
7,066,832 B2 6/2006 Willett
7,108,611 B2 * 9/2006 MacIlraith ..... A63B 53/06 473/340
7,121,958 B2 * 10/2006 Cheng ..... A63B 53/047 473/345
7,285,060 B2 10/2007 Williams
7,413,517 B2 * 8/2008 Butler, Jr. ..... A63B 53/04 473/330
7,604,550 B1 * 10/2009 Currie ..... A63B 53/047 473/342
7,651,413 B1 * 1/2010 Chen ..... A63B 53/06 473/349
8,012,040 B2 * 9/2011 Takechi ..... A63B 53/04 473/349
8,210,961 B2 * 7/2012 Finn ..... A63B 53/0466 473/345
8,491,405 B2 * 7/2013 Jorgensen ..... A63B 53/06 473/328
8,777,776 B2 * 7/2014 Wahl ..... A63B 53/047 473/345
8,801,541 B2 8/2014 Beach
9,283,448 B2 * 3/2016 Sander ..... A63B 53/0466
9,370,697 B2 * 6/2016 Beno ..... A63B 60/00
9,579,548 B2 * 2/2017 Boyd ..... A63B 53/047
9,675,849 B2 6/2017 Beach
9,731,170 B2 * 8/2017 Franklin ..... A63B 53/047
9,975,016 B2 * 5/2018 Nakamura ..... A63B 53/047
10,004,955 B2 6/2018 Henrikson
10,137,339 B1 * 11/2018 Forshner ..... A63B 53/047
10,150,019 B2 * 12/2018 Ines ..... A63B 60/00
10,150,021 B2 * 12/2018 Kitagawa ..... A63B 53/0466
10,166,444 B1 * 1/2019 Forshner ..... A63B 60/52
10,258,843 B2 4/2019 Morales
10,500,449 B2 12/2019 Henrikson
10,751,587 B2 8/2020 Clarke
10,758,789 B2 9/2020 Bacon
10,905,925 B2 2/2021 Morales
10,905,926 B2 2/2021 Morales
10,918,919 B2 2/2021 Morales
11,186,016 B2 * 11/2021 Martens ..... A63B 53/04
11,491,377 B1 * 11/2022 Sanchez ..... A63B 53/0429
2008/0004131 A1 * 1/2008 Lin ..... A63B 60/00 473/342
2014/0323237 A1 10/2014 Beno et al.
2018/0028882 A1 * 2/2018 Hebreo ..... A63B 53/047
2019/0192927 A1 6/2019 Bacon et al.
2020/0346081 A1 11/2020 Bacon
2021/0016137 A1 * 1/2021 Cleghorn ..... A63B 53/0416

* cited by examiner

GOLF CLUB HEAD WITH IMPROVED STRIKING FACE

RELATED APPLICATIONS

The present application is a continuation of co-pending U.S. application Ser. No. 17/959,197, filed on Oct. 3, 2022, which is a continuation-in-part of co-pending U.S. application Ser. No. 17/471,040, filed on Sep. 9, 2021, the disclosures of which are hereby incorporated by reference in their entirety.

FIELD OF THE INVENTION

The present invention relates generally to a golf club head with an improved striking face. More specifically, the present invention relates to a metalwood or iron type golf club head, wherein the striking face is further comprised out of a thickened central region, located near a geometric center of the striking face portion, a central transition region extending outward radially from the thickened central region, a thinned intermediate region, extending outward radially from the central transition region, a thickened stress reducing region, extending outward radially from the thinned intermediate region, and a thinned perimeter region, extending outward radially from the thickened stress reducing region, all of which combine to form the improved striking face.

BACKGROUND OF THE INVENTION

The striking face of a golf club head is the singular component in a golf club head that experiences the highest level of stress when impacting a golf ball. Moreover, with the striking face being the only component that comes in contact with a golf ball, it is one of the key critical components to any golf club design.

In order to improve the performance of a golf club head via the striking face, golf club designers have tried to create an extremely thin striking face, allowing the striking face to elastically deform when impacting a golf ball, thus increasing the speed of a golf ball once it leaves the striking face of the golf club head; all while staying within the rules of golf. U.S. Pat. No. 4,432,549 to Zebelean illustrates one of the earlier attempts to thin out the striking face of a golf club head by thinning out the upper portion of the striking face of a golf club head Thinning out the face is not the only way to improve performance of the striking face of a golf club head, as more current improvements include the adjustment of the thickness of the various portions of the striking face to improve performance. Building upon the already thinned face, U.S. Pat. No. 6,863,626 to Evans et al. illustrates one of the earlier attempts to vary the thickness of the striking face of a golf club head by disclosing a thickened central region that decreases outward from the center, to help slow down the speed of a golf ball at the center to create a larger area of improved speed and performance.

Further building upon the known technology of a thinned face that's combined with a thickened central portion, to further improvements to the performance of the golf club head U.S. Pat. No. 10,758,789 to Bacon et al, adds a thickened perimeter region at the extremities of the striking face, which the inventors claim to improve durability, increase ball speed, and increase characteristic time. However, the addition of this, although beneficial, is not optimized because the benefit of a thickened perimeter region is generally localized and does not need to extend all the way to the perimeter of the striking face as shown by U.S. Pat. No. 10,758,789.

Hence it can be seen that further improvements can be made to golf club heads that have a thinned face, thickened central region, and have a thickened perimeter region by removing unnecessary weight from the extremities of the perimeter of the striking face, and only localizing the thickened perimeter region at optimized locations that could benefit from such feature.

BRIEF SUMMARY OF THE INVENTION

One aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise, a thickened central region, located near a geometric center of the striking face portion, having a first thickness; a central transition region, extending outward radially from the thickened central region, having a variable thickness; a thinned perimeter region, extending outward radially from the central transition region, having a third thickness; a thickened stress reducing region, extending outward radially from the thinned intermediate region, having a fourth thickness; and a thinned perimeter region, extending outward radially from thickened stress reducing region, having a fifth thickness, wherein the thickened stress reducing region forms a ring protruding rearward from the internal rear surface of the striking face portion, and wherein the fourth thickness is greater than the first thickness.

In another aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise, a thickened central region, located near a geometric center of the striking face portion, having a first thickness; a central transition region, extending outward radially from the thickened central region, having a variable thickness; a thinned perimeter region, extending outward radially from the central transition region, having a third thickness; a thickened stress reducing region, extending outward radially from the thinned intermediate region, having a fourth thickness; and a thinned perimeter region, extending outward radially from thickened stress reducing region, having a fifth thickness, wherein the thickened stress reducing region forms a ring protruding rearward from the internal rear surface of the striking face portion, wherein the fifth thickness is less than the fourth thickness, and wherein the third thickness of the thinned intermediate region is the thinnest portion of the striking face portion.

In another aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise a thickened stress reducing region, located proximate a perimeter of said striking face portion, wherein the thickened stress reducing region forms a ring protruding rearward from the internal rear surface of the striking face portion, and wherein the thickened stress reducing region is placed at a distance of between about 15 mm to about 30 mm from a geometric center of the striking face portion, measured across a vertical cross-section passing through the geometric center of the striking face portion.

In another aspect of the present invention is a golf club head comprising multiple materials, wherein a gasket is placed in between a body portion of the golf club head and a face insert of the golf club head. The gasket being made of a different material than the body portion or the face insert. The construction providing reduced stress in the face insert, manipulation of performance characteristics, and improved sound and feel.

In another aspect of the present invention is a golf club head including: a body portion, the body portion including: a rear portion, a front portion opposite the rear portion, a heel portion including a hosel configured to connect to a shaft, a toe portion opposite the heel portion, a top portion, a sole opposite the top portion, a pocket on an interior of the body portion, and a perimeter ledge in the pocket, wherein the perimeter ledge is located proximate the heel portion, the sole, the toe portion, the top portion, and the front portion of the body portion; a face insert configured to be attached to the body portion at the front portion of the body portion; and a gasket located between the perimeter ledge and the face insert.

In another aspect of the present invention is an iron type golf club head including: a body portion, the body portion including: a rear portion, a front portion opposite the rear portion, a heel portion including a hosel configured to connect to a shaft, a toe portion opposite the heel portion, a topline, a sole opposite the topline, a pocket on an interior of the body portion, and a perimeter ledge in the pocket, wherein the perimeter ledge is located proximate the heel portion, the sole, the toe portion, the topline, and the front portion of the body portion; a face insert configured to be attached to the body portion at the front portion of the body portion, the face insert including a plurality of grooves extending in a heel-to-toe direction on an exterior surface; and a gasket located between the perimeter ledge and the face insert.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
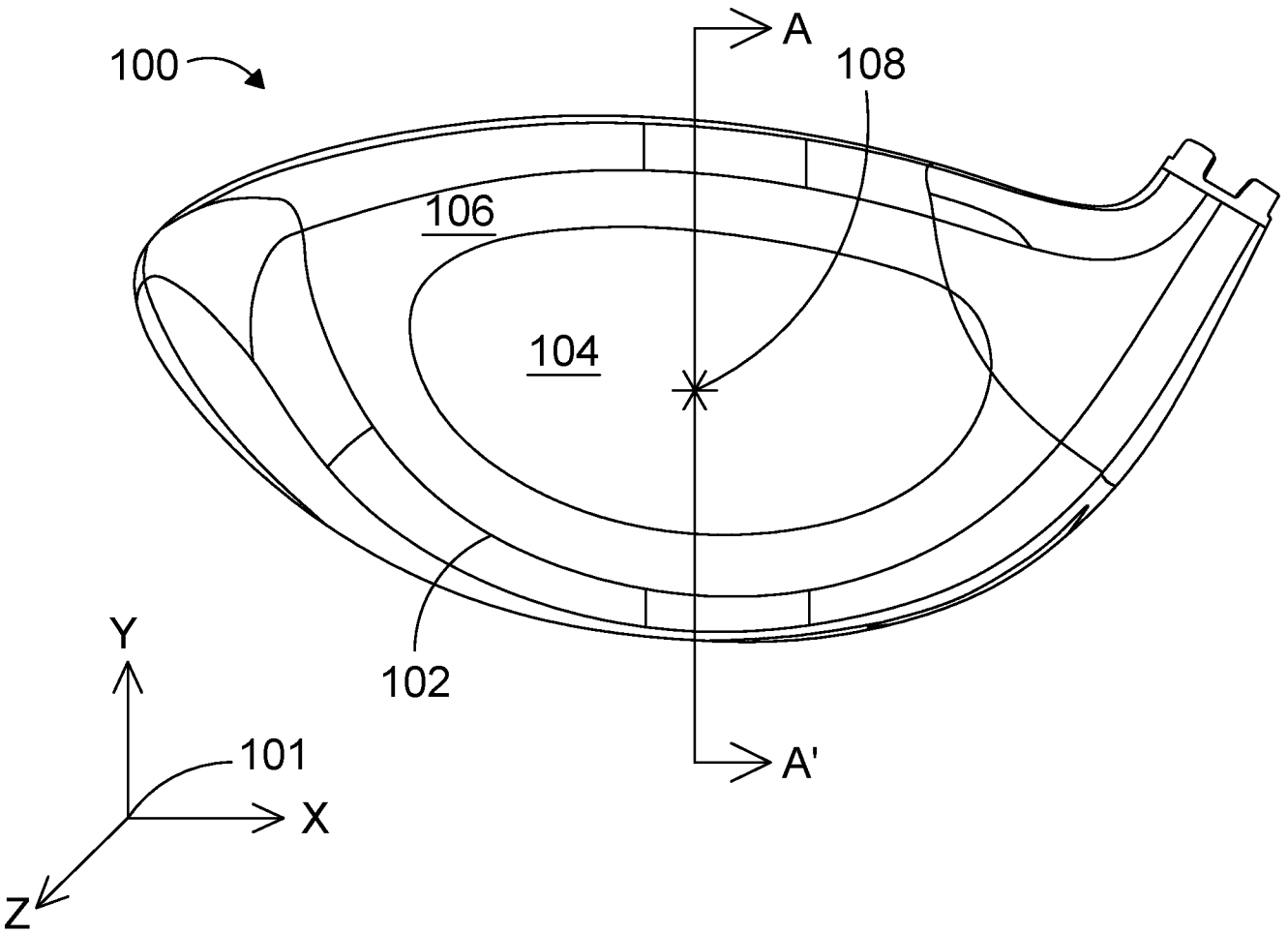
FIG. 1 of the accompanying drawings shows a frontal view of a golf club head in accordance with an exemplary embodiment of the present invention, allowing cross-sectional line A-A' to be shown.

FIG. 1 of the accompanying drawings shows a frontal view of a golf club head 100 in accordance with an exemplary embodiment of the present invention. First and foremost, FIG. 1 of the accompanying drawings shows a coordinate system 101, which defines the orientation of the golf club head 100 along the x, y, and z axes. The x-axis shown here is horizontal and spans in a heel to toe direction, with the positive axis pointing to the heel of the golf club head 100. The y-axis shown here is vertical and spans in a crown to sole direction, with the positive axis pointing to the crown of the golf club head 100. Finally, the z-axis shown here refers to the axis that points in and out of the page, and spans in a forward and back direction, with the positive axis pointing towards the front of the golf club head 100. This frontal view of the golf club head 100 shows the striking face portion 102, which in this embodiment is further comprised out of a face insert 104 and a face perimeter 106. FIG. 1 of the accompanying drawings also shows a cross-sectional line A-A' vertically along the y axis, along the y-z plane, allowing the internal geometry of the striking face portion 102 to be shown more clearly.

Figure 2:
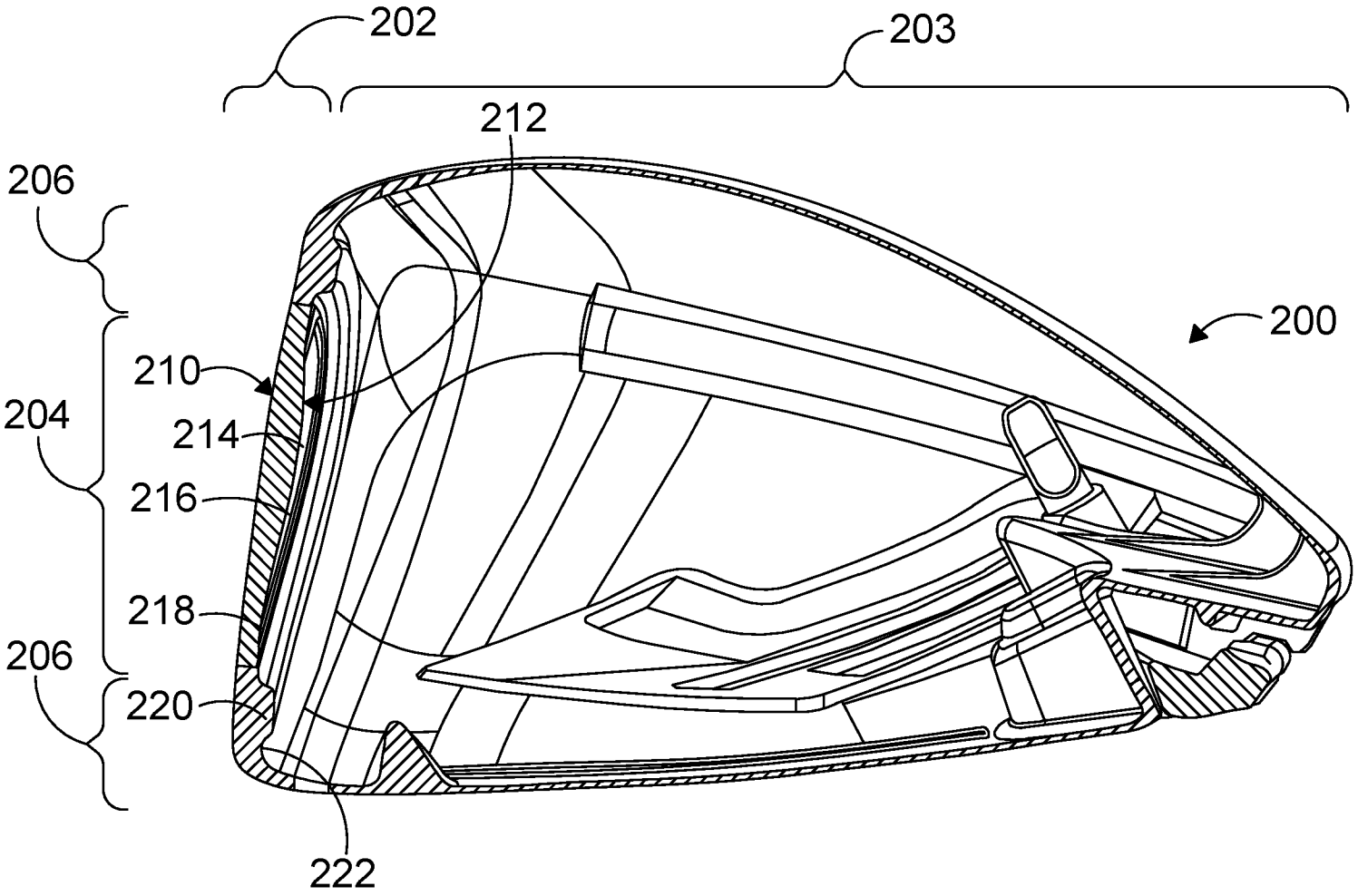
FIG. 2 of the accompanying drawings shows a cross-sectional view of a golf club head in accordance with an exemplary embodiment of the present invention, taken along cross-sectional line A-A' shown in FIG. 1.

FIG. 2 of the accompanying drawings shows a cross-sectional view of a golf club head 200, taken along cross-sectional line A-A' shown in FIG. 1. In this cross-sectional view of the golf club head 200 shown in FIG. 2, we can see that the golf club head 200 is has a striking face portion 202 and a rear body portion 203, attached to the rear of the striking face portion 202. The striking face portion 202, as defined in the present invention, refers to the portion of the golf club head 200 that is substantially planar, and located at the frontal portion of the golf club head 200, adapted to strike a golf ball. The striking face portion 202 is formed by the thickness created by a substantially planar frontal striking surface 210 and a rear internal surface 212 having a variable contour, thus creating a striking face portion with a variable face thickness profile. The demarcation between the striking face portion 202 and the rear body portion 203 occurs when the rear internal surface 212 deviates from a substantially planar vertical orientation towards a substantially horizontal orientation.

Finally, FIG. 2 of the accompanying drawings shows that in this embodiment, a face insert 204 is used and it closes an opening in the striking face portion 202 created by the face perimeter 206. In this embodiment of the present invention, the face insert 204 may generally be made from a titanium material for its light weight and high durability characteristics; and may generally be significantly thinner than traditional golf club heads having a similar construction due to the unique thickened stress reducing region 216 around the face perimeter 206. In this embodiment of the present invention, the thickened stress reducing region 220 around the face perimeter 206 allows for the face insert 204 to be thinner and lighter, yielding a mass of less than about 25 grams, more preferably less than about 24 grams, and most preferably less than about 23 grams, all without departing from the scope and content of the present invention. Compared to a face insert installed without the thickened stress reducing region 220 around the face perimeter 206, the mass of the face insert is decreased by approximately 12 grams.

Figure 3:
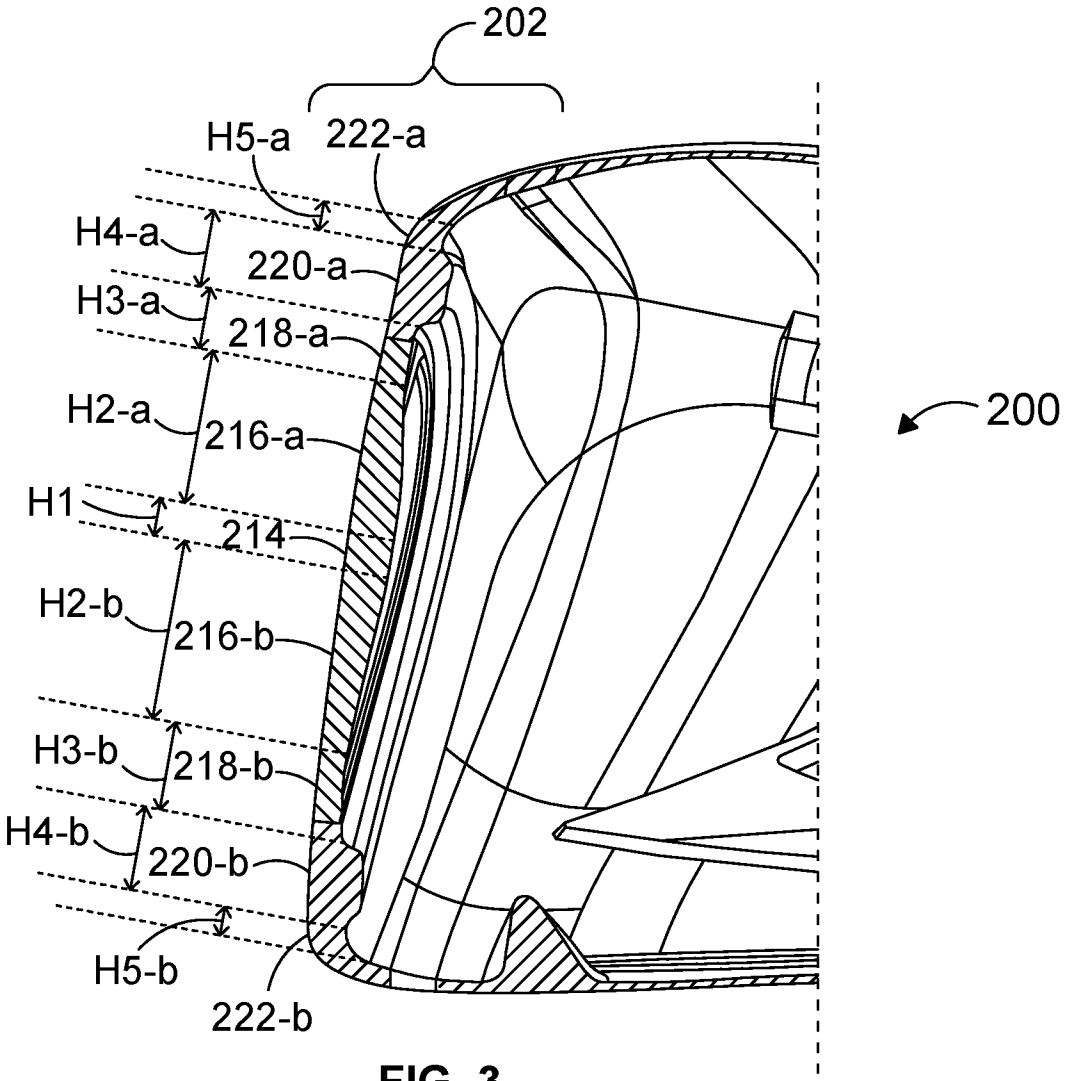
FIG. 3 of the accompanying drawings shows an enlarged cross-sectional view of a striking face portion of a golf club head in accordance with an exemplary embodiment of the present invention shown in FIG. 2.

In order to illustrate more detail regarding the thickened stress reducing region 220 around the face perimeter 206 together with the remainder of the striking face portion 202 geometry such as the thickened central region 214, the central transition region 216, the thinned intermediate region 216, and the thinned perimeter region 222, an enlarged view of the striking face portion 202 is provided in FIG. 3.

FIG. 3 of the accompanying drawings shows an enlarged cross-sectional view of the striking face portion 202 of a golf club head 200. This enlarged cross-sectional view allows the various heights of the striking face portion 202 to be shown more clearly, while FIG. 4 of the accompanying drawings will illustrate the various thicknesses of the striking face portion 202. In accordance with this shown exemplary embodiment of the present invention, the striking face portion 202 is further comprised of a thinned upper perimeter region 222-*a* and a thinned lower perimeter region 222-*b*, combining to form a thinned perimeter region 222. Located inward from the thinned perimeter region, the striking face portion 202 has an upper thickened stress reducing region 220-*a* and a lower thickened stress reducing region 220-*b* combining to form a thickened stress reducing region 220. Alternatively speaking, it can be said that the thickened stress reducing region 220 forms a ring that protrudes rearward from the internal surface 212 of the striking face portion 202. Located inward from the thickened stress reducing region, the striking face portion 202 has an upper thinned intermediate region 218-*a* and a lower thinned intermediate region 218-*b*, combining to form a thinned intermediate region 218. Located inward from the thinned intermediate region, the striking face portion 202 has an upper central transition region 216-*a* and a lower central transition region 216-*b*, combining to form the central transition region 216. Finally, the striking face portion 202 has a thickened central region 214 located inward of the central transition region 214.

In this embodiment of the present invention shown in FIG. 3, the height H1 of the thickened central region 214 may generally be between about 4.0 mm and about 15.0 mm, more preferably between about 4.0 mm and about 10.0 mm, and most preferably about 4.0 mm.

The height of the central transition region 216, in accordance with this embodiment of the present invention, may also be greater below the thickened central region 214 than above the thickened central region 214. Hence, in accordance with this embodiment, the height H2-a of the upper central transition region 216-*a* is between about 7.0 mm and about 11.0 mm, more preferably between about 8.0 mm and about 10.0 mm, and most preferably about 9.0 mm. The height H2-b of the lower central transition region 216-*b* may generally be between about 13.0 mm to about 17.0 mm, more preferably between about 14.0 mm to about 16.0 mm, and most preferably about 15.0 mm. However, it should be noted that in alternative embodiments, the height of the upper central transition region 216-*a* and the lower central transition region 216-*b* may be the same without departing from the scope and content of the present invention.

The height of the thinned intermediate region 218, in accordance with this embodiment of the present invention, may also be greater below the thickened central region 214 than above the thickened central region 214. Hence, in accordance with this embodiment, the height H3-a is generally between about 3.5 mm and about 5.5 mm, more preferably between about 4.0 mm and about 5.0 mm, and most preferably about 4.5 mm. The height H3-b of the lower central transition region 218-*b* may generally be between about 6.5 mm to about 8.5 mm, more preferably between about 7.0 mm to about 8.0 mm, and most preferably about 7.5 mm. However, it should be noted that in alternative embodiments, the height of the upper central transition region 218-*a* and the lower central transition region 218-*b* may be the same without departing from the scope and content of the present invention.

The height of the thickened stress reducing region 220, different from previous measurements, is the same measurement irrespective of whether the measurement is for the upper thickened stress reducing region 220-*a* or the lower thickened stress reducing region 220-*b*. Hence, in accordance with this embodiment, the height H4-a and H4-b are both between about 4.0 mm and about 6.0 mm, more preferably between about 4.5 mm and about 5.5 mm, and most preferably about 5.0 mm. Similar to the logic above, having different H4-a and H4-b values also does not deviate from the scope and content of the present invention, so long as both fall within the ranges articulated above. It is worth noting here that the height of the thickened stress reducing region 220 is critical to the proper functionality of the present invention, as it carefully balances the need to not add too much unnecessary mas to the striking face portion 202, but also the need to provide enough structural rigidity to reduce the stress from the face perimeter 106 (shown in FIG. 1) to allow the remainder of the striking face portion 202 to be made thinner and more efficient. The height of the thickened stress reducing region 220, combined with the thickness of the thickened stress reducing region 220 (to be discussed later in FIG. 4), will outline the optimized geometry to achieve the performance gains of the present invention.

Before moving on to a discussion regarding the thinned perimeter region 222, it is important to note that the placement of the thickened stress reducing region 220 relative to the geometric face center 108 (shown in FIG. 1) is critical to the achieve the proper performance gains in the present invention. This is especially true along the vertical cross-sectional plane passing through the geometric face center 108 (shown in FIG. 1) as shown here in the enlarged cross-sectional view shown in FIG. 3. The criticality of this specific cross-section, and the placement of the thickened stress reducing region 220 along this cross-section, derives from the tendency of the striking face portion 202 to exhibit higher stress risers in the upper face portion along this plane; hence the addition of the thickened stress reducing region 220. In this embodiment of the present invention, the thickened stress reducing region 220 may generally be placed at a distance of between about 15 mm to about 30 mm away from the geometric face center 105, along the cross-sectional plane A-A', more preferably placed at a distance of between about 17 mm to about 28 mm away from the geometric face center 105 (shown in FIG. 1), along the cross-sectional plane A-A', and most preferably between about 20 mm to about 25 mm away from the geometric face center 105 (shown in FIG. 1), along the cross-sectional plane A-A'.

The height of the thinned perimeter region 222, may also be greater below the thickened central region 214 than above the thickened central region 214. Hence, in accordance with this embodiment, the height H5-a is between about 1.8 mm and about 2.8 mm, more preferably between about 2.1 mm and about 2.5 mm, and most preferably about 2.3 mm. The height H5-b may generally be between about 2.3 mm to about 3.3 mm, more preferably between about 2.6 mm to about 3.0 mm, and most preferably about 2.8 mm. However, it should be noted that in alternative embodiments, the height of the upper thinned perimeter region 222-*a* and the lower thinned perimeter region 222-*b* may be the same without departing from the scope and content of the present invention.

Figure 4:
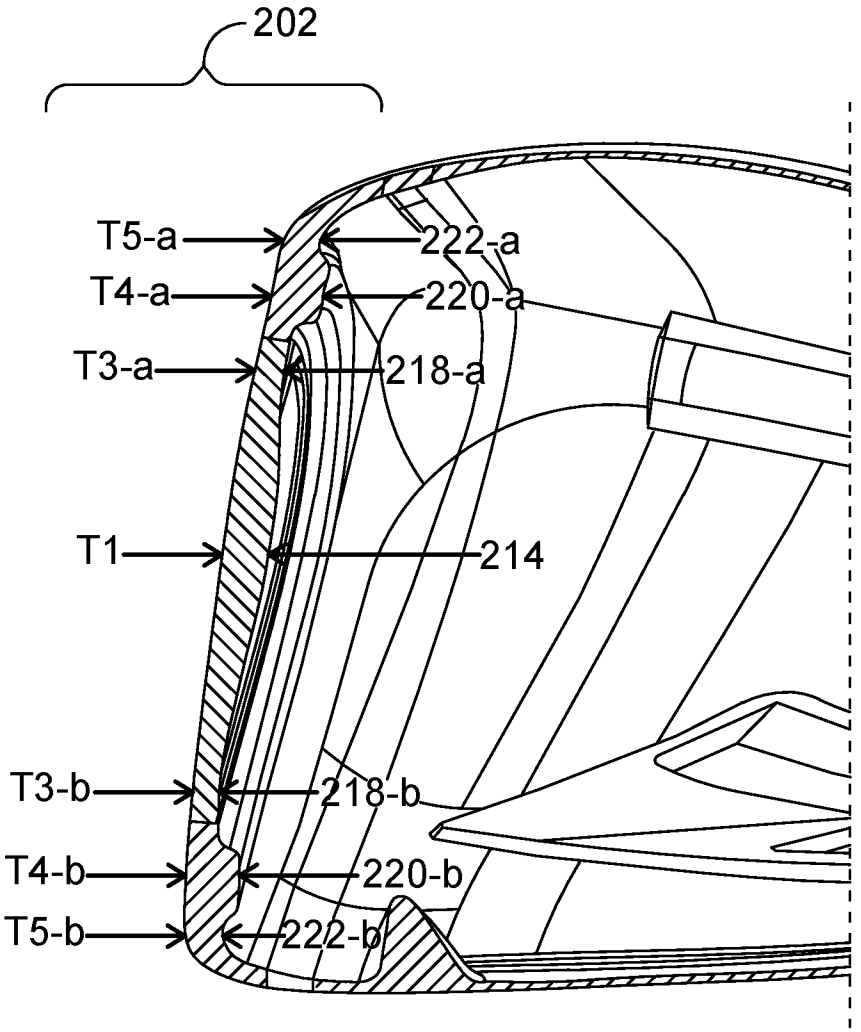
FIG. 4 of the accompanying drawings, again, shows an enlarged cross-sectional view of a striking face portion of a golf club head in accordance with an exemplary embodiment of the present invention shown in FIG. 2, allowing different features to be highlighted.

FIG. 4 of the accompanying drawings shows another enlarged cross-sectional view of the striking face portion 202 of a golf club head 200. In this cross-sectional view, the various thicknesses of the components of the striking face portion 202 is shown in more detail. In this current embodiment of the present invention, the thickened central region 214 may generally have a thickness T1 of less than about 3.6 mm, more preferably less than about 3.4 mm, and most preferably less than about 3.2 mm; as the goal of the present invention is to minimize the thickness of various components of striking face portion 202, via the introduction of the thickened stress reducing region 220 that alleviate stress on the striking face portion 202.

The thickness of the thinned intermediate region 218 may generally be the same irrespective of whether it's located at the upper thinned intermediate region 218-*a* or the lower thinned intermediate region 218-*b*. Hence, the thickness T3-a and T3-b are both less than about 2.5 mm, more preferably less than about 2.4 mm, and most preferably less than about 2.3 mm. However, in alternative embodiments of the present invention, T3-a and T3-b values may be slightly different from one another and will not deviate from the scope and content of the present invention, so long as both fall within the ranges articulated above.

The thicknesses of the thickened stress reducing region 220, shown here as an upper thickened stress reducing region 220-*a* having a thickness T4-a and lower thickened stress reducing region 220-*b* having a thickness T4-b, combines with the width of the thickened stress reducing region 220 define a geometry that is critical to the improved performance of the striking face portion 202 of the golf club head. In this embodiment, the thicknesses T4-a and T4-b, for the upper thickened stress reducing region 220-*a* and lower thickened stress reducing region 220-*b* respectively, are both the same, hence yielding a thickness of between about 3.6 mm to about 4.4 mm, more preferably between about 3.8 mm top about 4.2 mm, and most preferably about 4.0 mm. However, in alternative embodiments of the present invention, the thicknesses T4-a and T4-b could deviate slightly from one another without departing from the scope and content of the present invention, so long as it does not fall outside the scope of the thickness ranges defined above.

Once the thickness T4 and the height H4 of the thickened stress reducing region 220 have been defined, a preferred geometric shape of the thickened stress reducing region 220 can be established as a ratio of the thickness and the height. The preferred geometric shape will have a T over H Ratio defined by Equation (1) below:

$$T \text{ over } H \text{ Ratio} = \frac{\text{Thickness } T4 \text{ of Thickened Stress Reducing Region}}{\text{Height } H4 \text{ of Thickened Stress Reducing Region}} \quad \text{Eq. (1)}$$

The T over H Ratio of the thickened stress reducing region 220 of the striking face portion 202 in accordance with the present invention may generally be between about 0.6 to about 1.1, more preferably between about 0.7 to about 0.9, and most preferably about 0.8. Once again, as previously mentioned, this ratio is critical to achieving the stress reducing properties of the striking face portion 202, all while minimizing the unnecessary mass added by the addition of this thickened stress reducing region 220.

The thickness of the thinned perimeter region 222 may generally be the same irrespective of whether it's located at the upper thinned perimeter region 22-*a* or the lower thinned perimeter region 222-*b*. Hence, the thickness T5-a and T5-b are both less than about 3.0 mm, more preferably less than about 2.8 mm, and most preferably less than about 2.7 mm. However, in alternative embodiments of the present invention, T5-a and T5-b values may be slightly different from one another and will not deviate from the scope and content of the present invention, so long as both fall within the ranges articulated above.

Another important relationship worth highlighting here is the thickness T4 of the thickened stress reducing region 720 versus the thickness T1 of the thickened central region 714. Because the introduction of the thickened stress reducing region 720 greatly decreases the overall thickness and mass of the entire striking face portion 702, the resultant relationship between the two thicknesses is critically important to achieving the improved performance of the present invention. In this exemplary embodiment of the present invention, the ratio of T4 divided by T1 is generally greater than about 1, more preferably greater than about 1.15, and most preferably greater than about 1.375. Alternatively speaking, it can be said that the thickness T4 of the thickened stress reducing region 220 is greater than a thickness T1 of the thickened central region 214, or any other location along the entirety of the striking face portion 202. The thickest portion of the striking face portion 202 is located on the thickened stress reducing region 220.

Figure 5:
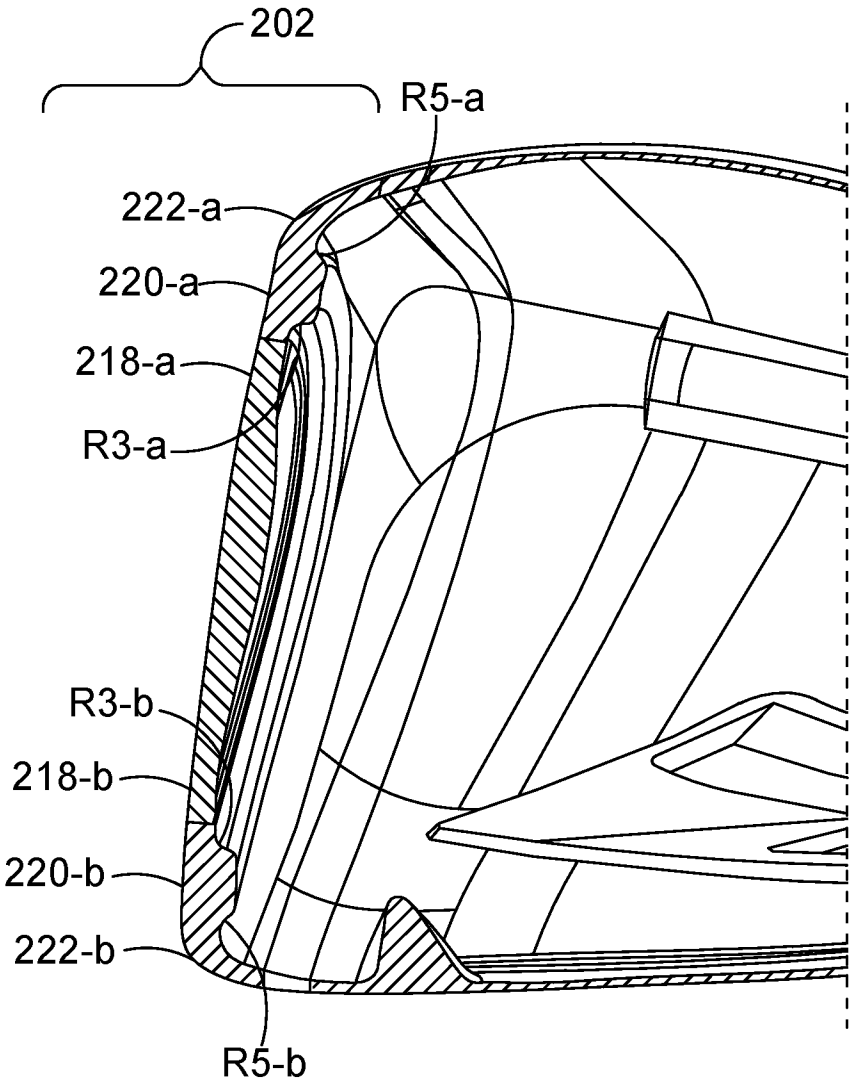
FIG. 5 of the accompanying drawings, once again, shows an enlarged cross-sectional view of a striking face portion of a golf club head in accordance with an exemplary embodiment of the present invention shown in FIG. 2, allowing different features to be highlighted.

FIG. 5 of the accompanying drawings shows that same enlarged cross-sectional view of the striking face portion 202 of a golf club head 200 as FIGS. 3 and 4, but this time focusing on the transition of the thickened stress reducing region 220 to its neighboring thinned intermediate region 218 and thinned perimeter region 222. In this embodiment of the present invention, the various radii around the thickened stress reducing region 220 is also critical to the proper functionality of the present invention, as undesirable radii not only does not serve the purpose of reducing stress but could also add to the manufacturing challenges. On top of everything, the radii also needs to be a balance of, on one hand, minimizing the undesirable weight additions attributed to the addition of the thickened stress reducing region 220, and on the other hand the stress and manufacturing challenges attributed to the thickened stress reducing region 220.

Radius R5-a and Radius R5-b indicate the radius of curvature or the blend from the thickened stress reducing region 220-*a* and 220-*b* towards the thinned perimeter region 222-*a* and 222-*b*. R5-a and R5-b in this embodiment may generally be the same number and is generally between about 1.0 mm and about 1.4 mm, more preferably between about 1.1 mm and about 1.3 mm, and most preferably about 1.2 mm. However, it should be noted that in alternative embodiments of the present invention R5-a and R5-b may be different from one another without departing from the scope and content of the present invention so long as it falls within the radius ranges articulated above.

Radius R3-a and Radius R3-b indicate the radius of curvature or the blend from the thickened stress reducing region 220-*a* and 220-*b* towards the thinned intermediate region 218-*a* and 218-*b*. R3-a and R3-b in this embodiment may generally be the same number and also the same as the R5-a and R5-b above between about 1.0 mm and about 1.4 mm, more preferably between about 1.1 mm and about 1.3 mm, and most preferably about 1.2 mm. However, it should be noted that in alternative embodiments of the present invention R3-a and R3-b may be different from one another without departing from the scope and content of the present invention so long as it falls within the radius ranges articulated above.

It is worth noting here that the radius of the blend from the thickened stress reducing region 220 towards the thinned perimeter region 222 and the thinned intermediate region 218, shown as R5 and R3 respectively, may generally be the same as one another. However, as previously mentioned, in alternative embodiments of the present invention, these numbers could differ from one another without departing from the scope and content of the present invention so long as they fall within the ranges above.

Figure 6A:
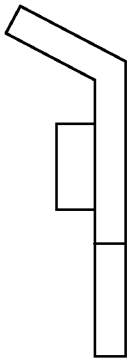
FIG. 6*a* of the accompanying drawing shows a representative cross-sectional view of a thickened stress reducing region accordance with an exemplary embodiment of the present invention.
Figure 6B:
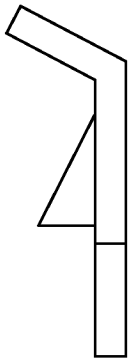
FIG. 6*b* of the accompanying drawings shows a representative cross-sectional view of a thickened stress reducing region in accordance with an alternative embodiment of the present invention.
Figure 6C:
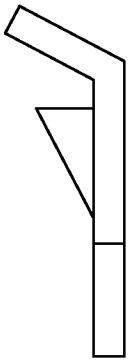
FIG. 6*c* of the accompanying drawings shows a representative cross-sectional view of a thickened stress reducing region in accordance with an even further alternative embodiment of the present invention.
Figure 6D:
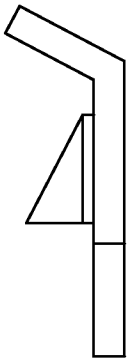
FIG. 6*d* of the accompanying drawings shows a representative cross-sectional view of a thickened stress reducing region in accordance with an even further alternative embodiment of the present invention.
Figure 6E:
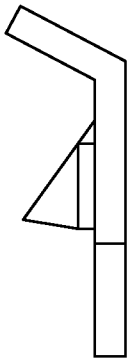
FIG. 6*e* of the accompanying drawings shows a representative cross-sectional view of a thickened stress reducing region in accordance with an even further alternative embodiment of the present invention.
Figure 6F:
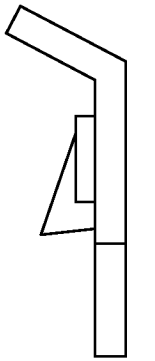
FIG. 6*f* of the accompanying drawings shows a representative cross-sectional view of a thickened stress reducing region in accordance with an even further alternative embodiment of the present invention.
Figure 6G:
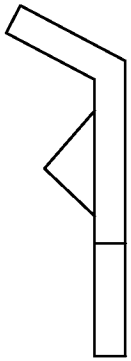
FIG. 6*g* of the accompanying drawings shows a representative cross-sectional view of a thickened stress reducing region in accordance with an even further alternative embodiment of the present invention.
Figure 6H:
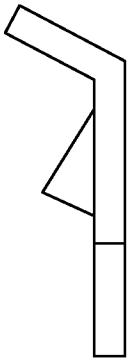
FIG. 6*h* of the accompanying drawings shows a representative cross-sectional view of a thickened stress reducing region in accordance with an even further alternative embodiment of the present invention.
Figure 6I:
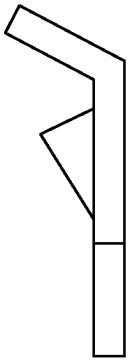
FIG. 6*i* of the accompanying drawings shows a representative cross-sectional view of a thickened stress reducing region in accordance with an even further alternative embodiment of the present invention.
Figure 6J:
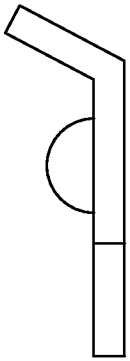
FIG. 6*j* of the accompanying drawings shows a representative cross-sectional view of a thickened stress reducing region in accordance with an even further alternative embodiment of the present invention.
Figure 6K:
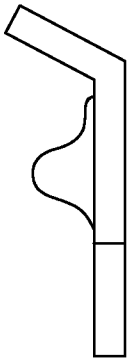
FIG. 6*k* of the accompanying drawings shows a representative cross-sectional view of a thickened stress reducing region in accordance with an even further alternative embodiment of the present invention.
Figure 6L:
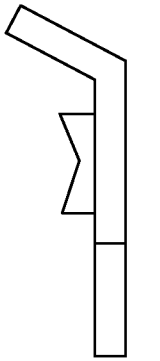
FIG. 6L of the accompanying drawings shows a representative cross-sectional view of a thickened stress reducing region in accordance with an even further alternative embodiment of the present invention.

FIGS. 6*a* through 6L of the accompanying drawings shows alternate geometries for the thickened stress reducing region 220. In FIG. 6*a*, a substantially rectangular design is shown here, like the design previously shown that added the transition radii. FIG. 6*b* of the accompanying drawings shows an alternate outward taper design of the thickened stress reducing region 220 in accordance with an alternative embodiment of the present invention. FIG. 6*c* of the accompanying drawings shows an alternate inward taper design of the thickened stress reducing region 220 in accordance with an alternative embodiment of the present invention. FIG. 6*d* of the accompanying drawings shows an alternate outward taper with constant offset design of the thickened stress reducing region 220 in accordance with an alternative embodiment of the present invention. FIG. 6*e* of the accompanying drawings shows an alternate outward taper with inner offset design of the thickened stress reducing region 220 in accordance with an alternative embodiment of the present invention. FIG. 6*f* of the accompanying drawings shows an alternate outward taper with outer offset design of the thickened stress reducing region 220 in accordance with an alternative embodiment of the present invention. FIG. 6*g* of the accompanying drawings shows an alternate triangular chevron design of the thickened stress reducing region 220 in accordance with an alternative embodiment of the present invention. FIG. 6*h* of the accompanying drawings shows an alternate inward offset triangular chevron design of the thickened stress reducing region 220 in accordance with an alternative embodiment of the present invention. FIG. 6*i* of the accompanying drawings shows an alternate outward offset triangular chevron design of the thickened stress reducing region 220 in accordance with an alternative embodiment of the present invention. FIG. 6*j* of the accompanying drawings shows an alternate hemisphere design of the thickened stress reducing region 220 in accordance with an alternative embodiment of the present invention. FIG. 6*k* of the accompanying drawings shows an alternate organic design of the thickened stress reducing region 220 in accordance with an alternative embodiment of the present invention. FIG. 6*b* of the accompanying drawings shows an alternate depression channel taper design of the thickened stress reducing region 220 in accordance with an alternative embodiment of the present invention.

Figure 7A:
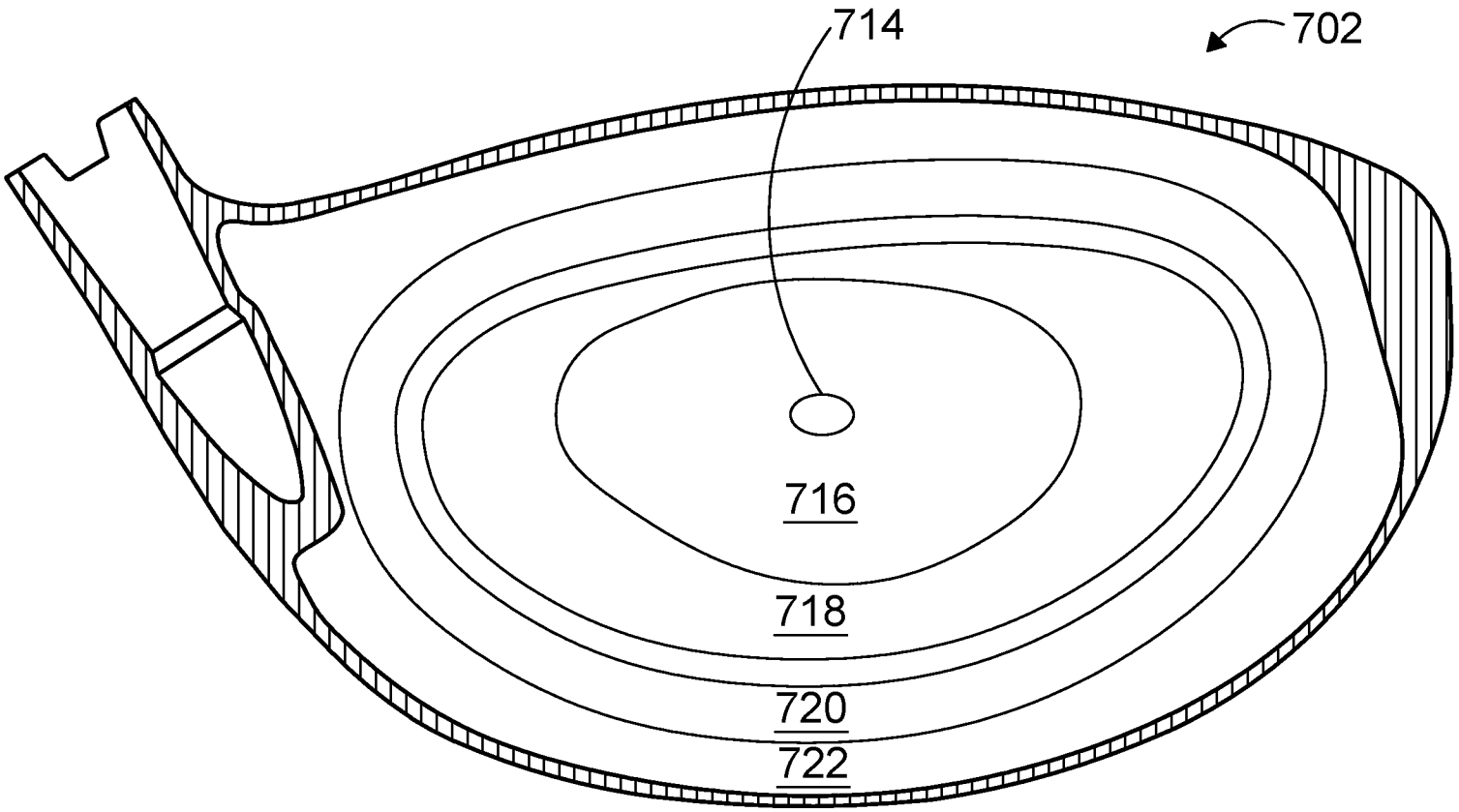
FIG. 7*a* of the accompanying drawings shows a rear shaded view of a striking face portion of a golf club head in accordance with an exemplary embodiment of the present invention.
Figure 7B:
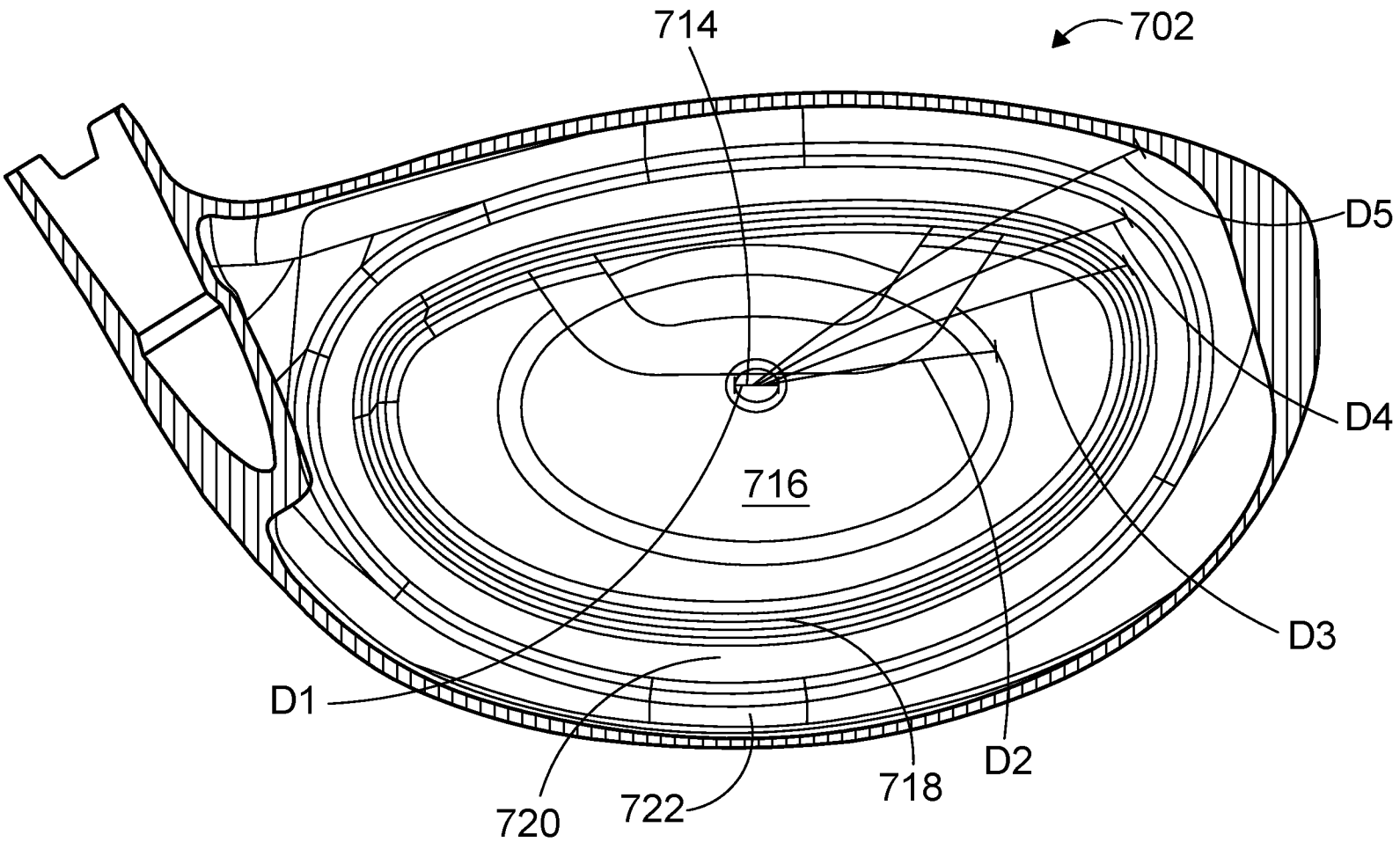
FIG. 7*b* of the accompanying drawings shows a rear view of a striking face portion of a golf club head in accordance with an exemplary embodiment of the present invention.

FIGS. 7*a* and 7*b* show a rear view of the striking face portion 702 of a golf club head in accordance with an exemplary embodiment of the present invention. In FIG. 7*a*, a shaded view is presented to provide a better visual of the various components of the striking face portion 702. In FIG. 7*a*, a thinned perimeter region 722 forms the outer perimeter of the striking face portion 702. Inward from the thinned perimeter region 722, we can see the thickened stress reducing region 720. Inward from the thickened stress reducing region 720 is the thinned intermediate region 718. Inward from the thinned intermediate region 718 is the central transition region 716. Finally, at the geometric center of the striking face portion 702 is the thickened central region 714. In addition to illustrating the various components of the striking face portion 701, FIG. 7*a* also illustrates how the height of the various components can vary depending on where it is located on the face, and the previous measurements of the various component heights were only referring to a cross-sectional plane along the geometric center of the face as shown in FIG. 1. In one example, once can see that the height of the intermediate transition region 718 is generally smaller at the crown and sole portion of the striking face portion 702 when compared to the height of the intermediate transition region 718 at the heel and toe portion of the striking face portion 702.

To better illustrate the differences of the height of the various components along different portions of the face, a non-shaded rear view of the striking face portion 702 is provided in FIG. 7*b*. In addition to the above, FIG. 7*b* allows the radial distances of the various components to be shown in more detail, as all measurements are taken from the geometric center 108 (shown in FIG. 1) of the face; like the previous discussion regarding the location of the thickened stress reducing region 220 in FIG. 2. However, the distances provided here are not constrained in any specific cross-sectional plane A-A' like the previous discussion in FIG. 2, but rather a measurement of the minimum and maximum distances in any radial direction. In this rear view of the striking face portion 702 shown in FIG. 7*b*, we can see that the outer perimeter of the thickened central region 714 is generally located within a projected distance D1 of between about 4.00 mm and about 14.0 mm from a geometric face center across any radial direction. The outer perimeter of the central transition region 716 may generally be located at a distance D2 of between about 13.0 mm and about 30.0 mm from the geometric face center across any radial direction. The outer perimeter of the thinned intermediate region 718 may generally be located at a distance D3 of between about 17.0 mm and about 40.0 mm from the face center across any radial direction. The outer perimeter of the thickened stress reducing region 720 may generally be located at a distance D4 of between about 15.0 mm and about 46.0 mm from the face center across any radial direction. Finally, the outer perimeter of the thinned perimeter region 722 may generally be located at a distance D5 of between about 25.50 mm and about 55.5 mm from the face center across any radial direction.

Figure 8:
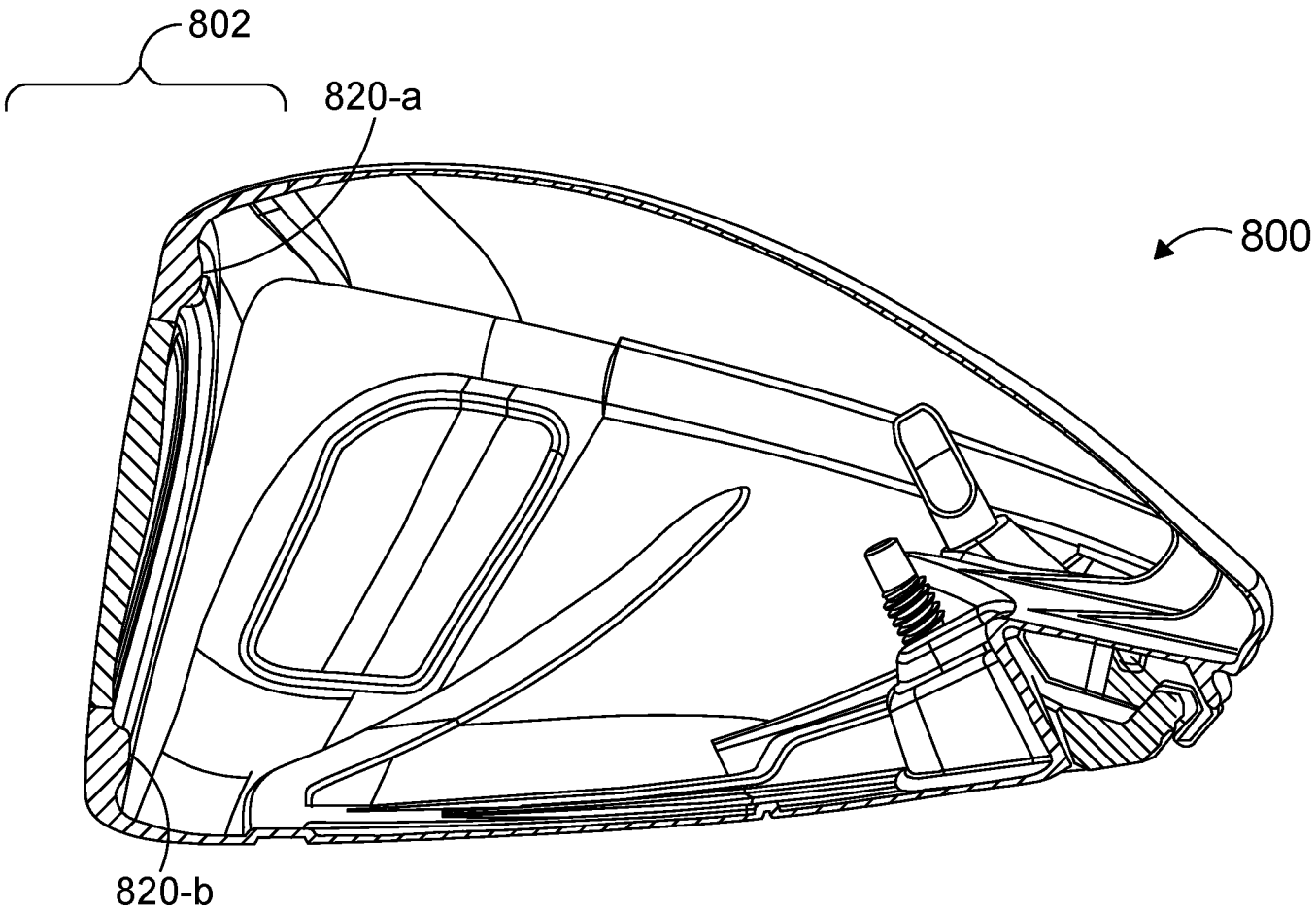
FIG. 8 of the accompanying drawings shows a cross-sectional view of a golf club head in accordance with a further alternative embodiment of the present invention, taken along cross-sectional line A-A' shown in FIG. 1.

FIG. 8 of the accompanying drawings shows a cross-sectional view of a golf club head 800, in accordance with an alternative embodiment of the present invention, taken along cross-sectional line A-A' shown in FIG. 1. In this cross-sectional view of the present invention, the shape and geometry of upper thickened stress reducing region 820-*a* is changed to be different from the lower thickened stress reducing region 820-*b* to help address high stress levels that generally occur in the upper crown region of the striking face portion 802. In order to illustrate this difference in height and radius of curvature of the blend between the upper thickened stress reducing region 820-*a* and the lower thickened stress reducing region 820-*b*, an enlarged view of the striking face portion 802 is provided in FIG. 9.

Figure 9:
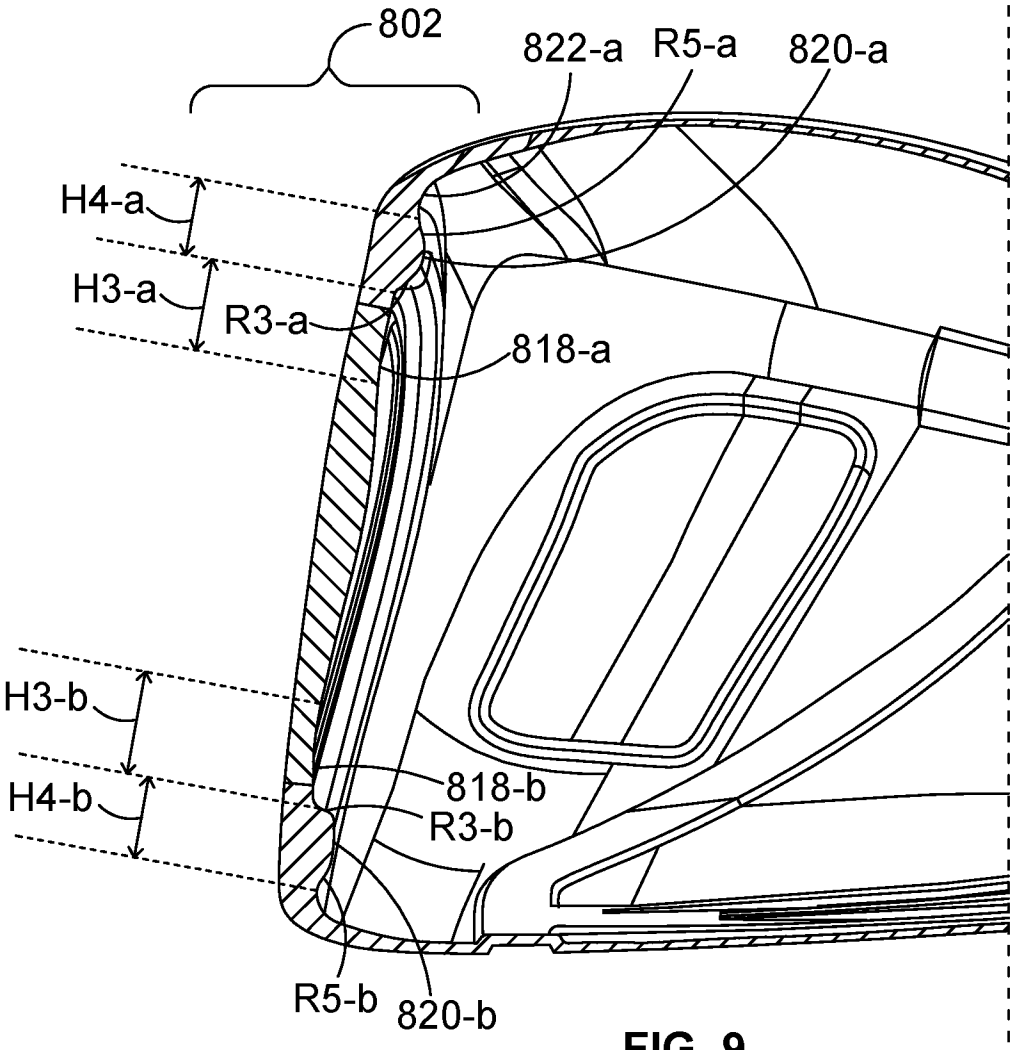
FIG. 9 of the accompanying drawings shows an enlarged cross-sectional view of a striking face portion of a golf club head in accordance with an alternative embodiment of the present invention shown in FIG. 8.

FIG. 9 of the accompanying drawings shows an enlarged view of the cross-sectional view of the striking face portion 802 of the golf club head 800 shown in FIG. 8. In this enlarged cross-sectional view, only the features that differentiate this embodiment of the present invention from prior embodiments have been highlighted. In this alternative embodiment of the present invention, the height H4-a of the upper thickened stress reducing region 820-*a* is no longer the same as height H4-b of the lower thickened stress reducing region 820-*b*. In fact, the height H4-a of the upper thickened stress reducing region 820-*a* is reduced to address stress raisers that often arise in the upper part of the striking face portion 802. Resultingly, due to the reduction in height H4-a of the upper thickened stress reducing region 820-*a*, the height H3-a of the upper thinned intermediate region 818-*a* is increased. In addition to the above, to further reduce the stress, the radius R3-a between the upper thickened stress reducing region 820-*a* and the upper thinned intermediate region 818-*a* is increased to create a more gradual blend at this location. Finally, unrelated to addressing the stress levels of the striking face portion 802, the radius R5-a between the upper thickened stress reducing region 820-*a* and the upper thinned perimeter region 822-*a* is also increased to soften the blend to allow for case of manufacturability.

Diving into the numbers, the height H4-a of the upper thickened stress reducing region 820-*a* in accordance with this embodiment of the present invention, may generally be between about 3.1 mm to about 3.9 mm, more preferably between about 3.3 mm top about 3.7 mm, and most preferably about 3.5 mm, which is about 0.5 mm shorter than its counter part H4-b located at the lower thickened stress reducing region 820-*b*. The height H3-a of the upper thinned intermediate region 818-*a* in accordance with this current embodiment of the present invention, may generally be between about 6.5 mm to about 8.5 mm, more preferably between about 7.0 mm to about 8.0 mm, and most preferably about 7.5 mm, which makes it approximately the same as it's counter part H3-b located at the lower thinned intermediate region 818-*b*.

In addition to changes in the height, the radius R3-a and R5-a of the upper thickened stress reducing region 820-*a* have also been altered to be different from its counter part at the lower thickened stress reducing region 820-*b*. By increasing the radius of curvature of R3-a, the more gradual transition between the two neighboring components help eliminate stress risers that could occur at that portion of the striking face portion 802. The R3-a in accordance with this embodiment of the present invention may generally be greater than about 1.50 mm, more preferably greater than about 1.60 mm, and more preferably greater than about 1.70 mm. The radius of curvature R5-a on the other hand, is also increased to be more gradual, but this time for manufacturing reasons allowing for a less pronounced region of reduced casting flow. Thus R5-a in accordance with this embodiment of the present invention may generally be greater than about 1.50 mm, more preferably greater than about 1.60 mm, and more preferably greater than about 1.70 mm. Hence it is worth noting here that in this embodiment, it is critical that the radius of curvature of the transition of the upper thickened stress reducing region 820-*a* be greater than a radius of curvature of the transition of the lower thickened stress reducing region 820-*b*, as the striking face portion 802 often exhibits higher stress levels at that location.

Figure 10A:
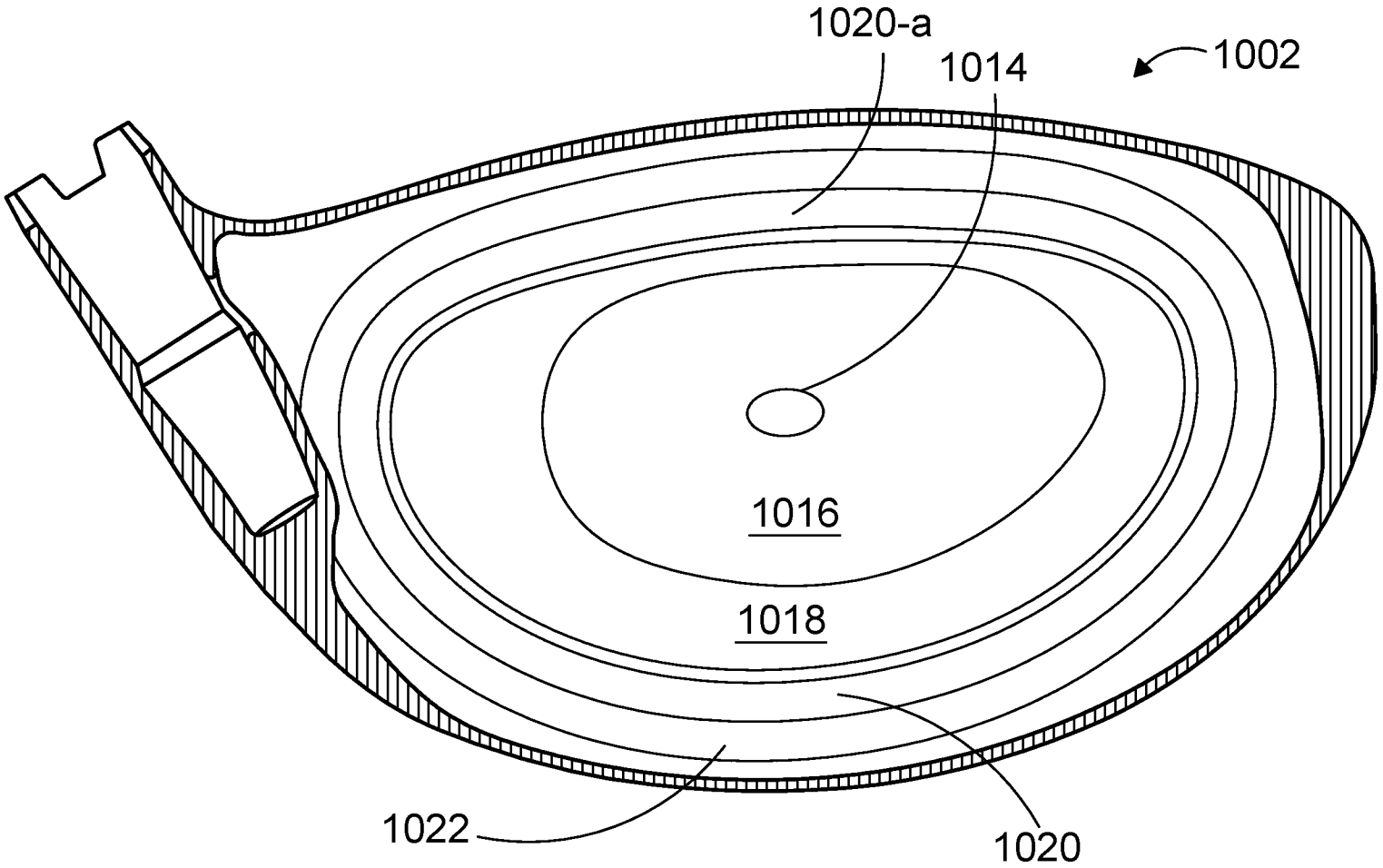
FIG. 10*a* of the accompanying drawings shows a rear shaded view of a striking face portion of a golf club head in accordance with an alternative embodiment of the present invention.
Figure 10B:
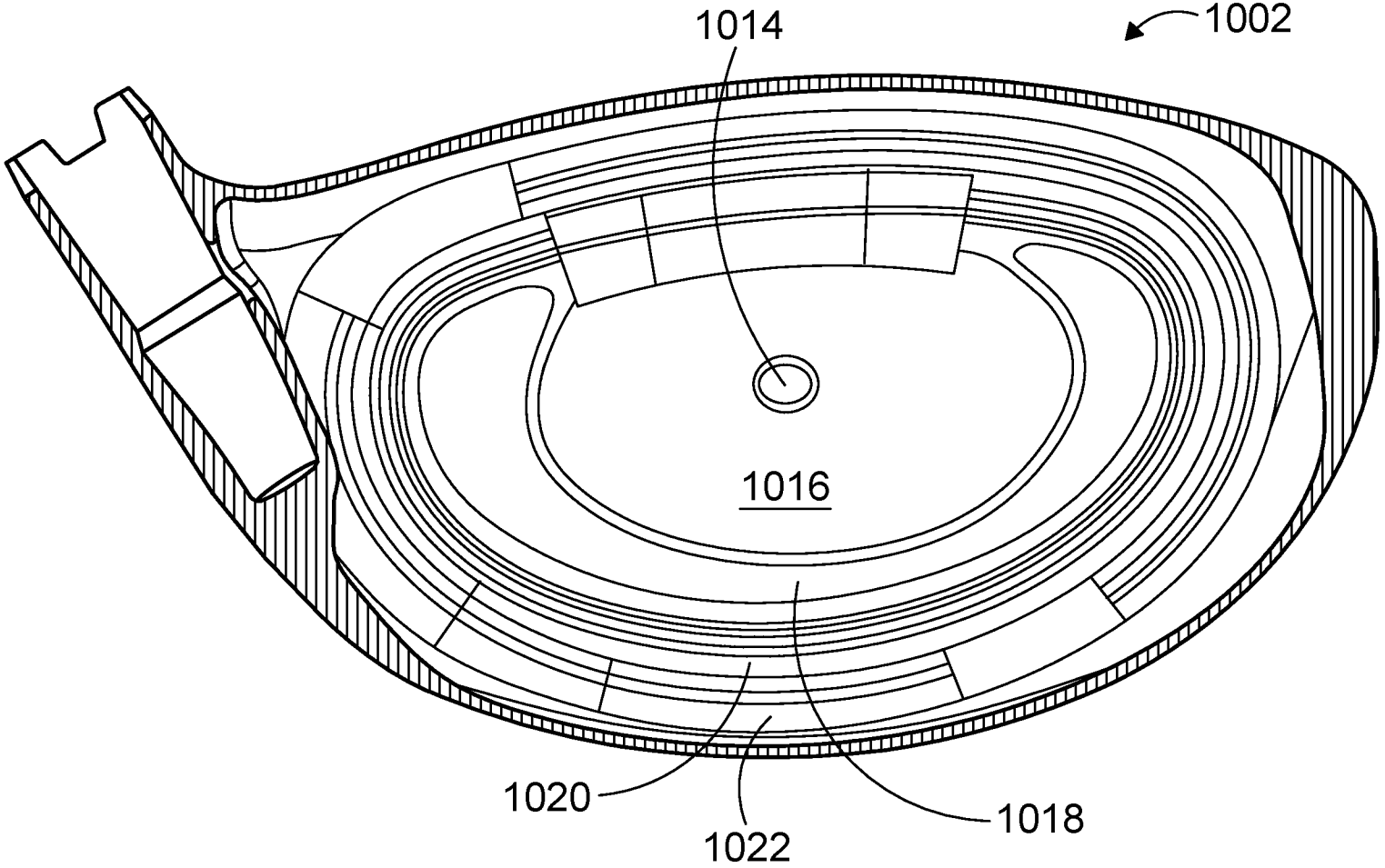
FIG. 10*b* of the accompanying drawings shows a rear view of a striking face portion of a golf club head in accordance with an alternative embodiment of the present invention.

FIGS. 10*a* and 10*b* show a rear view of the striking face portion 1002 of a golf club head in accordance with an exemplary embodiment of the present invention. In FIG. 10*a*, a shaded view is presented to provide a better visual of the various components of the striking face portion 1002. In this shaded view shown in FIG. 10*a* and the wireframe view shown in FIG. 10*b*, the adjustments to the upper thickened stress reducing region 1020-*a* can be seen, and its height H4-a (shown in FIG. 9) is smaller when compared to the remaining portions of the thickened stress reducing region 1020-*a*. Another thing worth noting here that was previously not mentioned is that in the current exemplary embodiment of the present invention, the entire thickened stress reducing region 1020 takes on the shape of a ring encircles the central portion of the striking face portion 1002. However, in alternative embodiments of the present invention, the thickened stress reducing region 1020 may not need to encircle the striking face portion 1002 completely and can partially surround the striking face portion without departing from the scope and content of the present invention. Alternatively speaking, the thickened stress reducing region 1020 may only encircle less than 360 degrees around the face, less than about 270 degrees around the face, less than 180 degrees around the face, all without departing from the scope and content of the present invention.

Figure 11:
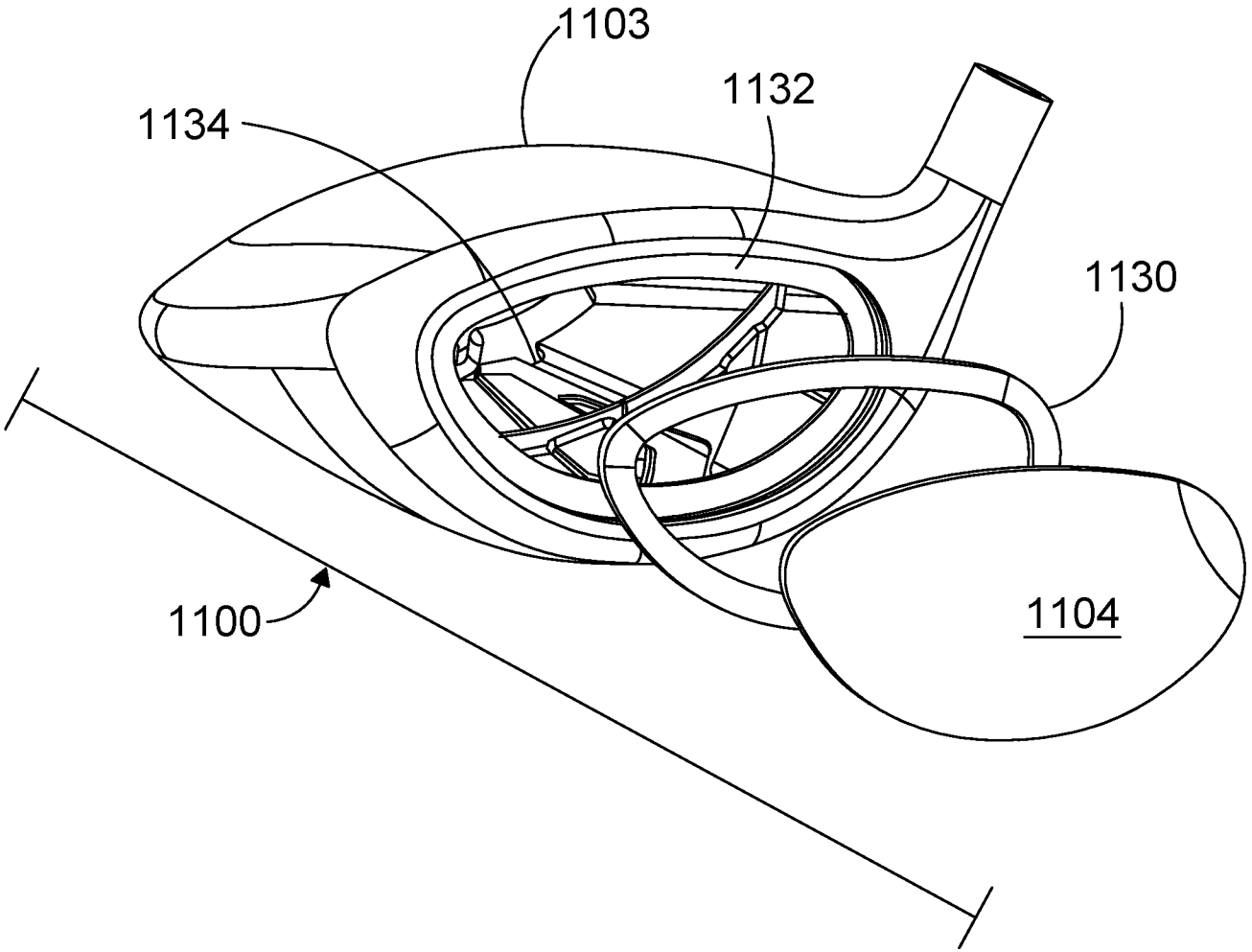
FIG. 11 of the accompanying drawings shows an exploded view of a golf club head in accordance with an even further alternative embodiment of the present invention.
Figure 12:
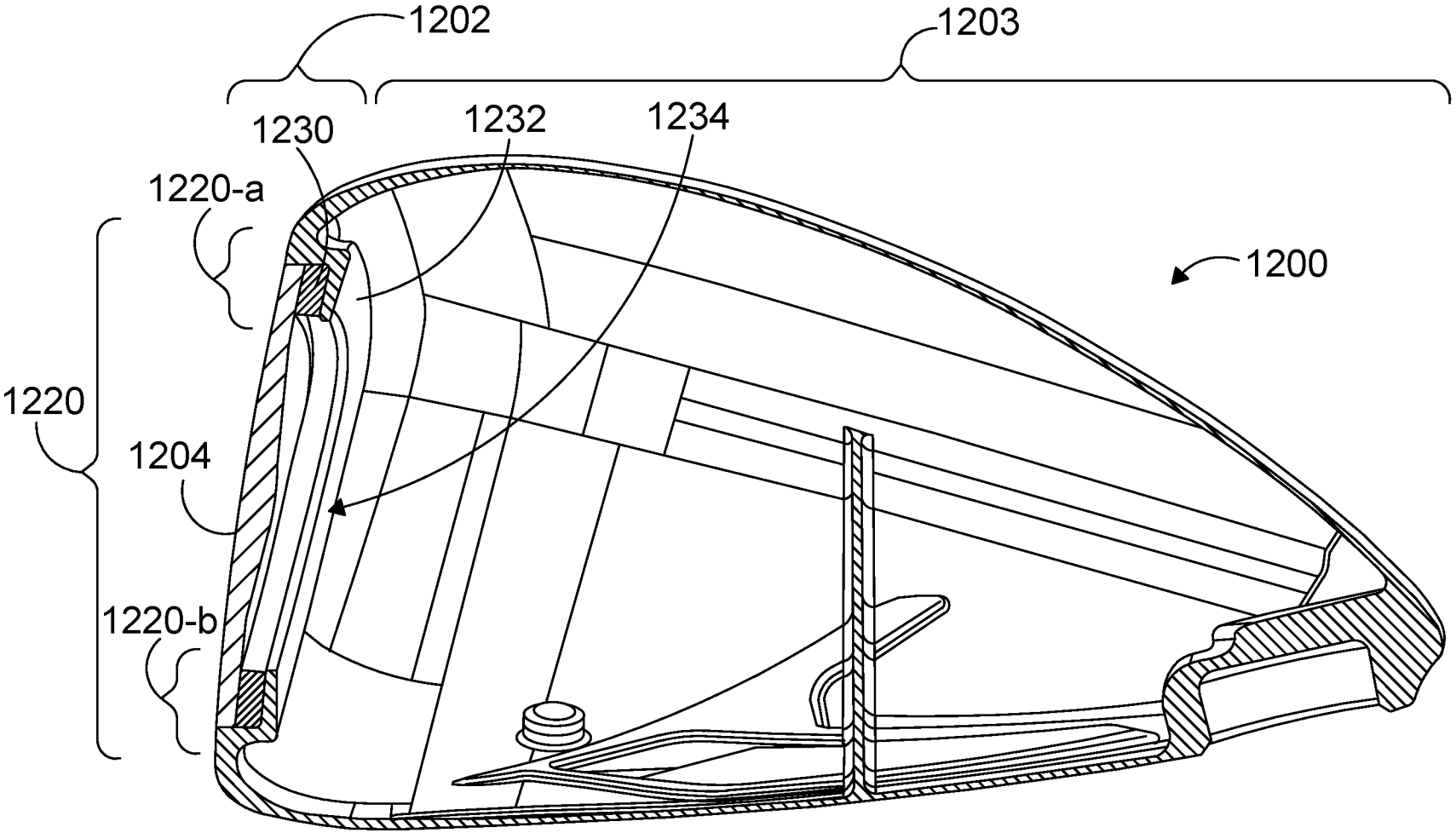
FIG. 12 of the accompanying drawings shows a cross-sectional view of a golf club head in accordance with the even further alternative embodiment of the present invention.
Figure 13:
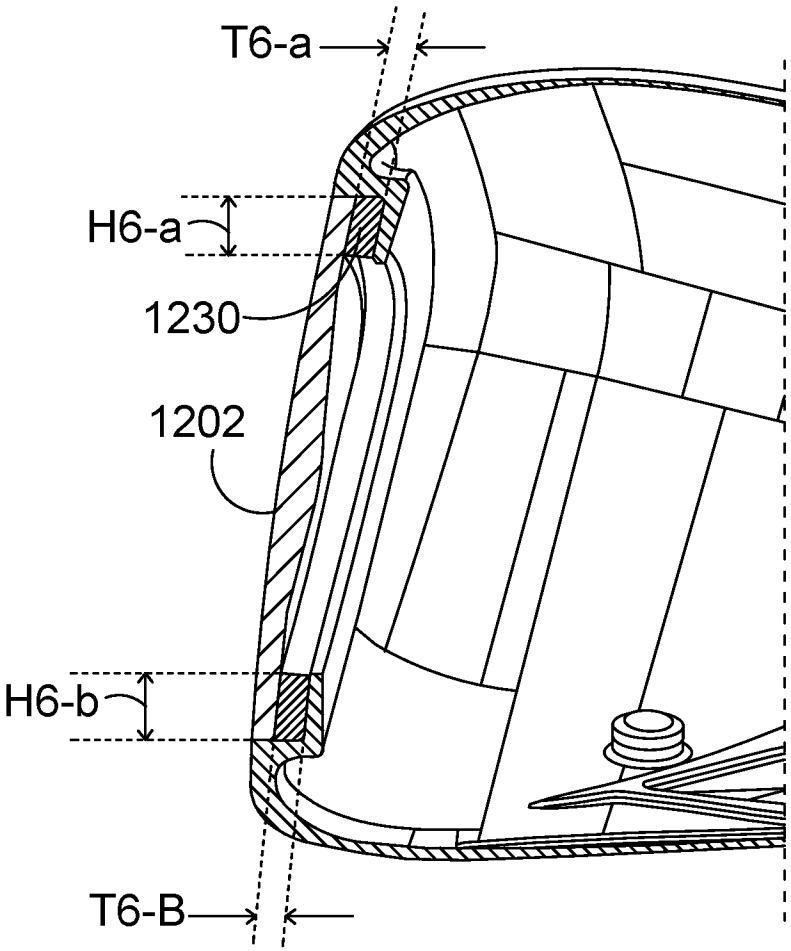
FIG. 13 of the accompanying drawings shows an enlarged cross-sectional view of a striking face portion of a golf club head in accordance with an even further alternative embodiment of the present invention.

FIGS. 11 through 13 of the accompanying drawings shows a golf club head in accordance with a further alternative embodiment of the present invention, wherein the thickened stress reducing region is formed out of multiple materials to achieve the further improve upon the stress reducing capabilities of the thickened stress reducing region.

FIG. 11 of the accompanying drawings shows an exploded perspective view of a golf club head 1100 in accordance with a further alternative embodiment of the present invention, wherein the thickened stress reducing region is further formed out of multiple materials. In this exploded cross-sectional view of the golf club head 1100 shown in FIG. 11, the body portion 1103 has a pocket 1134 with a perimeter ledge 1132, wherein the perimeter ledge 1132 helps receive a gasket 1130 and the gasket 1130 separates the face insert 1104 from the perimeter ledge 1132. The combination of the perimeter ledge 1132, the gasket 1130, and the perimeter of the face insert 1104 combine to create the thickened stress reducing region (shown in FIG. 12) in this embodiment of the present invention.

FIG. 12 of the accompanying drawings shows a cross-sectional view of a golf club head 1200 in accordance with an alternative embodiment of the present invention, taken along cross-sectional line A-A' shown in FIG. 1. In this cross-sectional view of the golf club head 1200, we can see that the golf club head 1200, similar to previous embodiments, can be split into a frontal striking face portion 1202 and a rear body portion 1203. The frontal striking face portion 1202 is further comprised out of an opening pocket 1234 adapted to receive a face insert 1204 like previous embodiments. However, in this embodiment of the present invention, instead of having the face insert 1204 being welded directly onto the perimeter of the pocket 1234 as it is commonly known in the industry, the opening pocket 1234 creates a perimeter ledge 1232 that is recessed from the external plane of the striking face, and the perimeter ledge

1232 is adapted to receive a gasket 1230 that separates face insert 1204 from the perimeter ledge 1232. In this cross-sectional view of the present invention, we can clearly see that the combination of the perimeter ledge 1232, the gasket 1230, and the perimeter of the face insert 1204 combine to create the thickened stress reducing region 1220. The thickened stress reducing region 1220 in this embodiment may further be defined as an upper thickened stress reducing region 1220-*a* and a lower thickened stress reducing region 1220-*b*, both of which have dimensional measurements similar to previous embodiments described previously.

In this embodiment of the present invention, the face insert 1204, gasket 1230, and perimeter ledge 1232 may generally be bonded together using some type of a glue adhesive. However, in alternative embodiments of the present invention, the three components that form the thickened stress reducing region 1220 that may have different material properties, may also rely on alternate bonding techniques such as brazing, swaging, or even mechanical fastening all without departing from the scope and content of the present invention so long as the face insert 1204 is not directly bonded to the perimeter ledge 1232 itself.

The material used to create the gasket 1230 is also critical in this embodiment of the present invention, as it may help reduce stress around the perimeter of the frontal striking face portion 1202. In this embodiment, the material used to create the gasket may generally have a modulus of elasticity, or Young's modulus of between about 5 GPa and about 120 GPa, more preferably between about 10 GPa and about 80 GPa, and most preferably about 30 GPa. In addition to the above, the gasket 1230 may also have a density of less than about 2,000 g/cc, more preferably less than about 1,900 g/cc, and most preferably less than about 1,800 g/cc, all without departing from the scope and content of the present invention.

In order to illustrate some of the dimensions of the gasket 1230 itself, an enlarged cross-sectional view of the striking face portion 1202 is provided in FIG. 13. In this view shown in FIG. 13, we can see that the gasket 1230 may have an upper gasket height H6-a and a lower gasket height H6-b that are approximately the same. H6-a and H6-b in accordance with this embodiment of the present invention may generally be between about 3.0 mm to about 7.0 mm, more preferably between about 4.0 mm to about 6.0 mm, and most preferably about 5.0 mm. FIG. 13 also shows the thickness T6 of the gasket, illustrated as an upper gasket thickness T6-a and a lower gasket thickness T6-b, both of which are approximately the same in this embodiment of the present invention. Hence, T6-a and T6-b in accordance with this embodiment of the present invention may generally be between about 0.3 mm to about 0.7 mm, more preferably between about 0.4 mm to about 0.6 mm, and most preferably about 0.5 mm.

Based on the thickness and height measurements above, it can be said that the gasket 1230 may have a T over H Ratio defined by Equation (2) below:

$$T \text{ over } H \text{ Ratio} = \frac{\text{Thickness } T6 \text{ of Gasket}}{\text{Height } H6 \text{ of Gasket}} \qquad \text{Eq. (2)}$$

The T over H Ratio of the gasket 1230 may generally be between about 0.04 and about 0.23, more preferably between about 0.06 to about 0.15, and most preferably about 0.1.

It should also be noted that although the thickness and height of the gasket 1230 is the same for the upper portion of the gasket 1230 and the lower portion of the gasket 1230, the thickness and height of the gasket could be different from one another without departing from the scope and content of the present invention. In one exemplary embodiment, the upper portion of the gasket 1230 could be thicker while the lower portion of the gasket 1230 could be thinner, to help the striking face portion 1202 deflect more downward upon impact with a golf ball to reduce lower launch and spin without departing from the scope and content of the present invention. Needless to say, if the thickness of the gasket 1230 are to be manipulated, the depth of the perimeter ledge 1232 is generally adjusted accordingly to create a seamless flush look of the golf club head in its resting neutral position. Alternatively, the thickness of the material could be maintained, but the modulus adjusted to achieve the same effects without departing from the scope and content of the present invention.

FIGS. 14 through 26 of the accompanying drawings show an iron type golf club head in accordance with an embodiment of the present invention, wherein a thickened region is formed out of multiple materials to improve stress reducing capabilities, performance characteristics, and damping.

Figure 14:
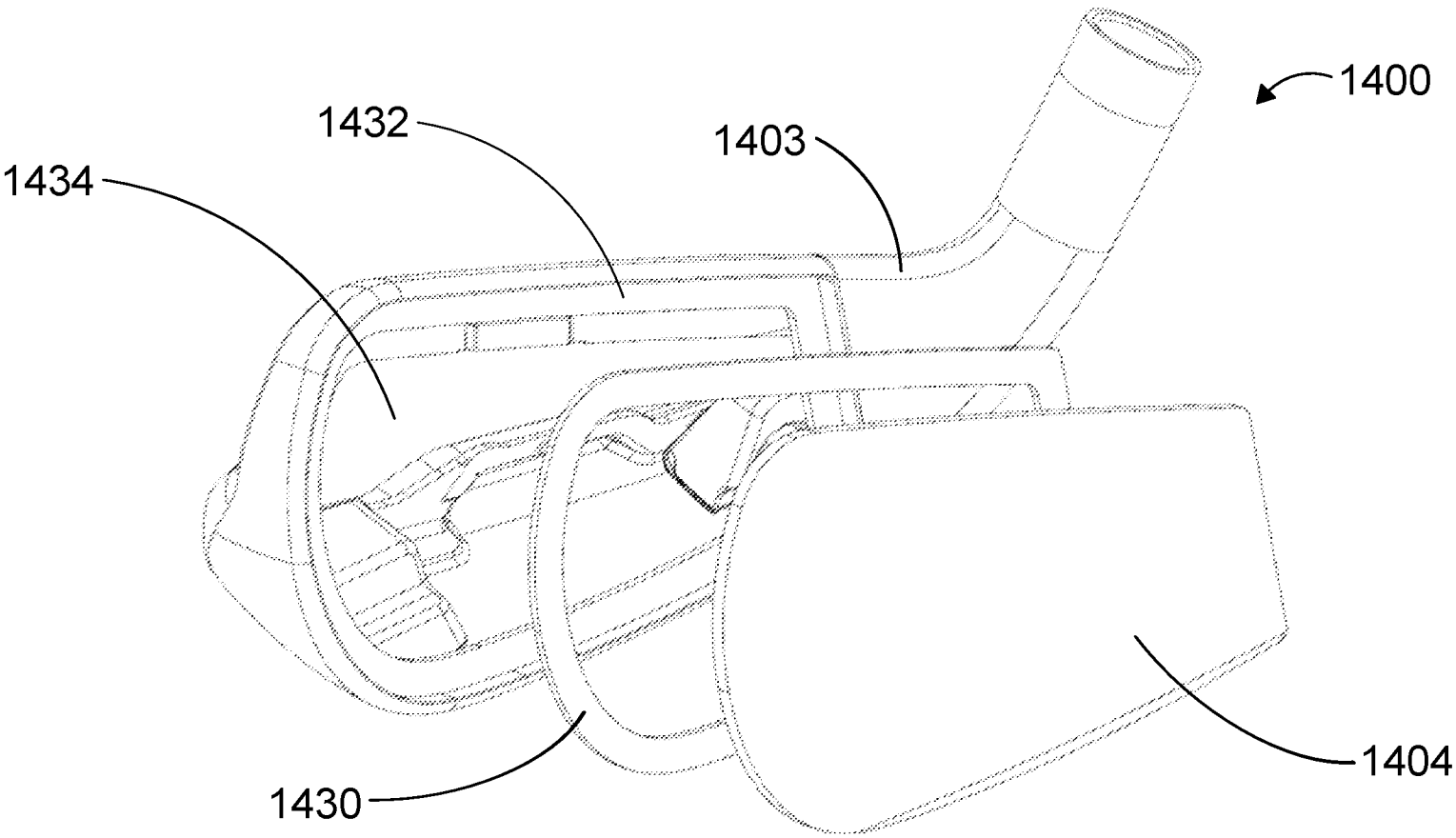
FIG. 14 of the accompanying drawings shows an exploded view of a golf club head in accordance with an embodiment of the present invention.

FIG. 14 of the accompanying drawings shows an exploded perspective view of a golf club head 1400 in accordance with an embodiment of the present invention, wherein the thickened region is formed out of multiple materials. The golf club head 1400 includes a front portion located where the golf club head 1400 is intended to strike a golf ball, a rear portion located opposite the front portion, a heel portion having a hosel configured to connect to a shaft, a toe portion located opposite the heel portion, a sole located on a bottom portion of the golf club head 1400, and a topline located opposite the sole. As shown in the exploded view in FIG. 14, the golf club head 1400 includes a body portion 1403 having a pocket 1434 on an interior of the body portion 1403 with a perimeter ledge 1432, wherein the perimeter ledge 1432 is configured to receive a gasket 1430. The gasket 1430 is positioned between the perimeter ledge 1432 and a face insert 1404 of the golf club head 1400. The gasket 1430 may be made of a material different than the material of the body portion 1403 and different than a material of the face insert 1404. Preferably, the gasket 1430 is made of a material softer than the material of the face insert 1404. The gasket 1430 may be made of a composite material or polymeric material having a modulus of elasticity between about 2 MPa and 120 GPa, more preferably between about 200 MPa and 80 GPa, and most preferably between about 0.5 GPa and 40 GPa. The gasket 1430 may also be made of a metal such as tungsten. The gasket 1430 may have a thickness between about 0.2 mm and 4 mm, more preferably between about 0.5 mm and 3 mm, and most preferably between about 1 mm and 2 mm. The gasket 1430 improves performance of the golf club head 1400 by providing a freer boundary condition at the perimeter. The gasket 1430 also improves the sound and feel of the golf club head 1400 by providing damping for the face insert 1404 during impact with a golf ball. When the golf club head 1400 is fully assembled, the perimeter ledge 1432 may be recessed from a front surface of the face insert 1404 a distance between about 1 mm and 6 mm, more preferably between about 2 mm and 5 mm, and most preferably between about 3 mm and 4 mm. The perimeter ledge 1432 may have a thickness between about 0.5 mm and 4 mm, more preferably between about 0.75 mm and 3 mm, and most preferably between about 1 mm and 2 mm. The face insert 1404 may have constant thickness or have variable thickness to achieve more consistent performance across the face. The face insert 1404 may be made from steel, titanium, or composite material. The combination of the perimeter ledge 1432, the gasket 1430, and the perimeter of the face insert 1404 combine to create the thickened stress reducing region (shown in FIGS. 15 and 16).

Figure 16:
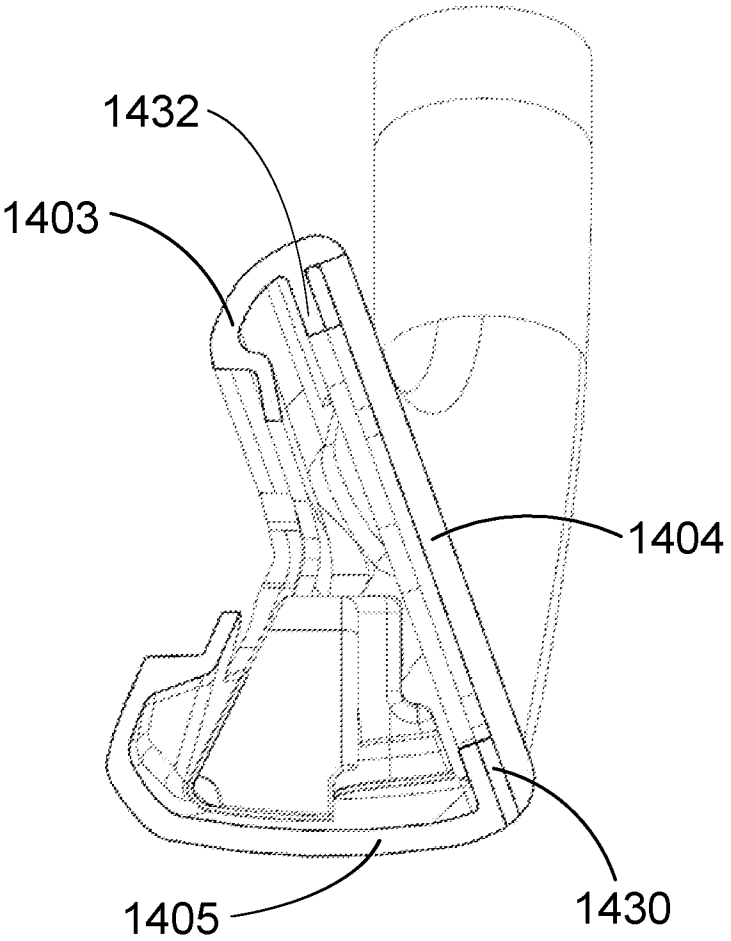
FIG. 16 of the accompanying drawings shows a cross-sectional view of a golf club head in accordance with an embodiment of the present invention.
Figure 15:
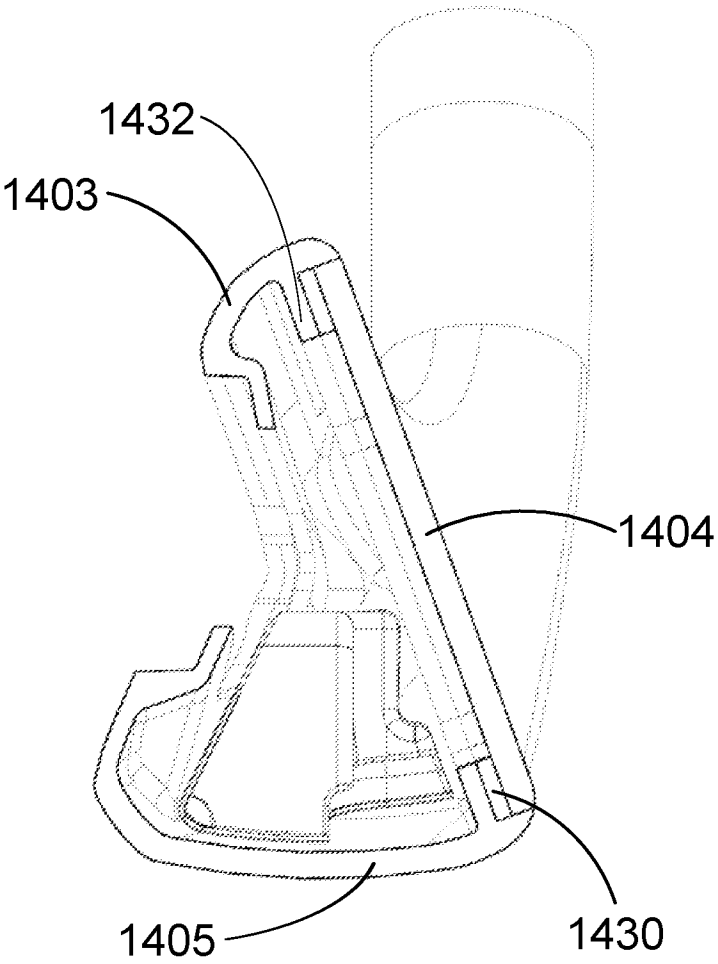
FIG. 15 of the accompanying drawings shows a cross-sectional view of a golf club head in accordance with an embodiment of the present invention.

FIG. 15 of the accompanying drawings shows a cross-sectional view of the golf club head 1400 shown in FIG. 14. In this cross-sectional view of the golf club head 1400, lower portions of the gasket 1430 and the face insert 1404 rest against an upper portion of a sole 1405 of the golf club head 1400. FIG. 16 shows an alternative embodiment of the golf club head 1400 wherein a lower portion of the gasket 1430 and a lower portion of the face insert 1404 form a portion of the sole 1405 of the golf club head 1400.

Figure 17:
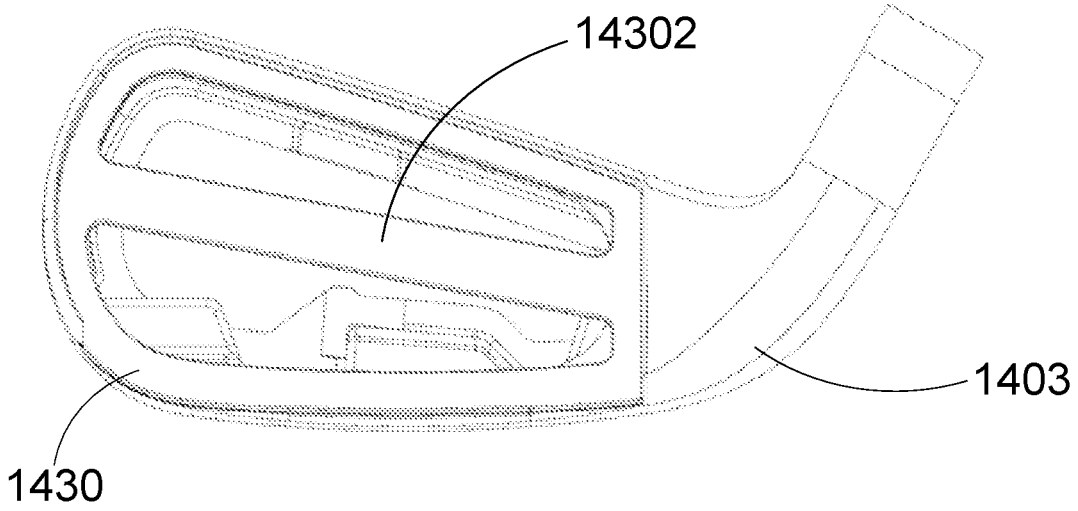
FIG. 17 of the accompanying drawings shows a front view of a golf club head in accordance with an embodiment of the present invention.
Figure 18:
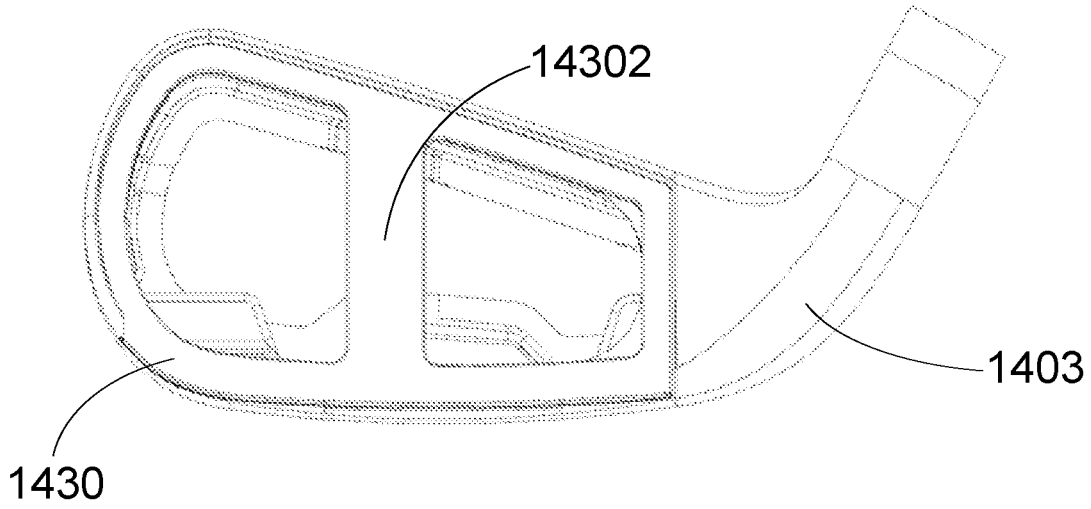
FIG. 18 of the accompanying drawings shows a front view of a golf club head in accordance with an embodiment of the present invention.

FIGS. 17 and 18 show alternative embodiments of the golf club head 1400, wherein the gasket 1430 includes a bridge 14302 that spans across the pocket 1434. The bridge 14302 provides additional damping capabilities, reduces stress in the face insert 1404, and helps normalize performance characteristics across the face insert 1404. In one embodiment, as shown in FIG. 17, the bridge 14302 may span across the pocket 1434 in a heel-to-toc direction. In another embodiment, as shown in FIG. 18, the bridge 14302 may span across the pocket 1434 in a topline-to-sole direction. In the embodiment shown in FIG. 18, the bridge 14302 may be positioned to overlap the geometric center of the face insert 1404, or the bridge 14302 may be positioned to overlap the face center of the face insert 1404, wherein the face center is defined as a location equidistant from a heelwardmost portion of scorelines on the face insert 1404 and a toewardmost portion of scorelines on the face insert 1404.

Figure 19:
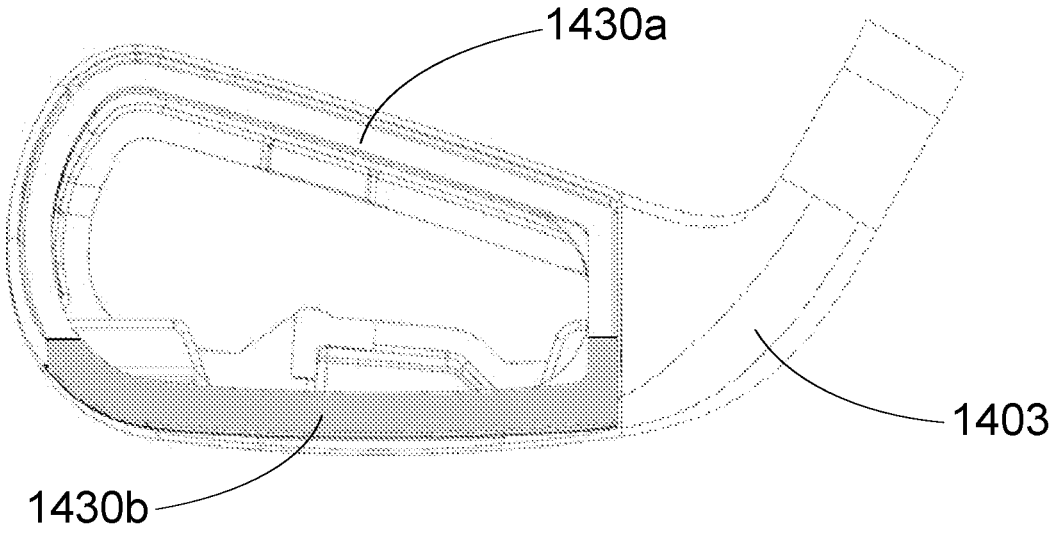
FIG. 19 of the accompanying drawings shows a front view of a golf club head in accordance with an embodiment of the present invention.
Figure 20:
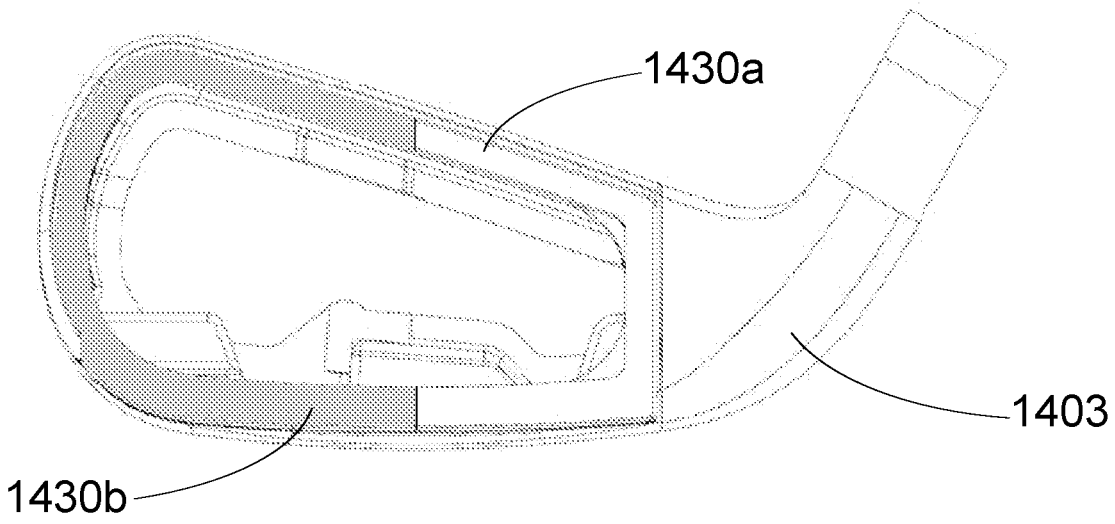
FIG. 20 of the accompanying drawings shows a front view of a golf club head in accordance with an embodiment of the present invention.

FIGS. 19 and 20 show alternative embodiments of the golf club head 1400, wherein the gasket 1430 is formed from multiple materials to achieve targeted performance characteristics across the face insert 1404. In one embodiment, as shown in FIG. 19, the gasket 1430 may be formed of a first material 1430*a* in a topline region and a second material 1430*b* in a sole region. The first material 1430*a* may be a harder material, such as a composite material, than the second material 1430*b*, which may be a polymeric material or other softer material. Additionally, the first material 1430*a* may be a softer material, such as a polymeric material, than the second material 1430*b*, which may be a composite material or other harder material. Forming the gasket 1430 using multiple materials including a harder material and a softer material allows, for instance, the golf club head 1400 to have a coefficient of restitution (COR) value in between the COR values of a golf club head 1400 having the gasket 1430 made completely from the harder material and a golf club head 1400 having the gasket 1430 made completely from the softer material. In another embodiment, as shown in FIG. 20, the gasket 1430 may be formed of the first material 1430*a* in a heel region and the second material 1430*b* in a toe region. The multiple materials of the gasket 1430 can alter the relative ball speed across the face insert 1404 including normalizing the ball speed across the face insert 1404.

Figure 22:
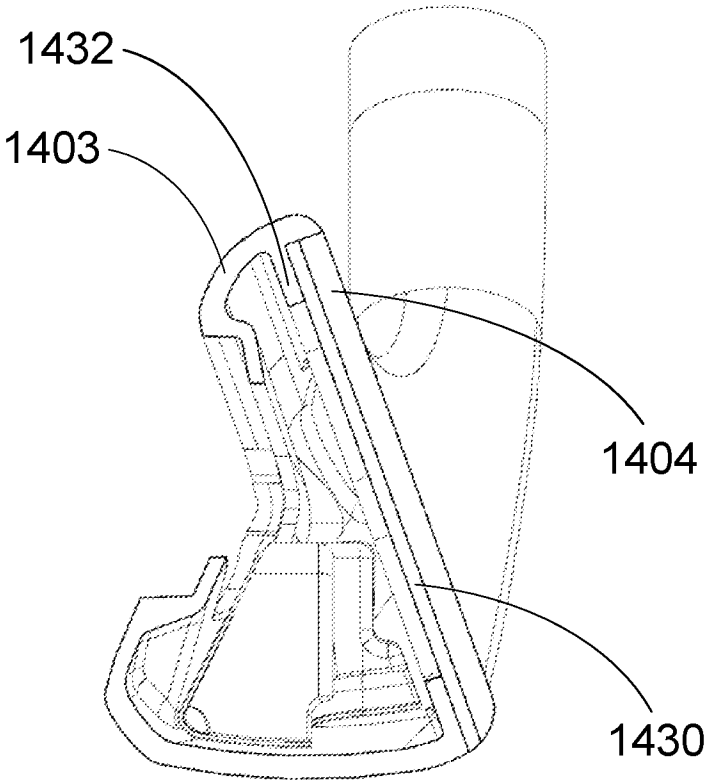
FIG. 22 of the accompanying drawings shows a cross-sectional view of a golf club head in accordance with an embodiment of the present invention.
Figure 21:
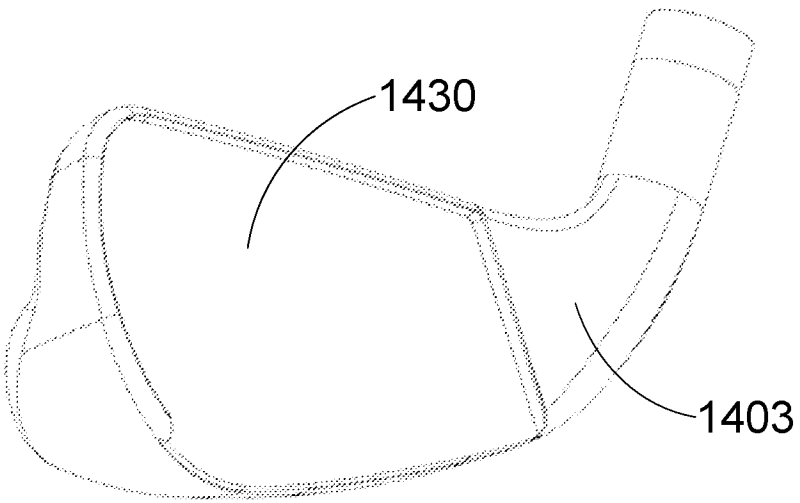
FIG. 21 of the accompanying drawings shows a perspective view of a golf club head in accordance with an embodiment of the present invention.

FIGS. 21 and 22 show an alternative embodiment of the golf club head 1400, wherein the gasket 1430 spans across an entirety of the pocket 1434. In this configuration, the gasket 1430 provides additional damping capability as well as stress reduction across the face insert 1404.

In the embodiments shown in FIGS. 14-22 of the present invention, the face insert 1404, the gasket 1430, and the perimeter ledge 1432 may be bonded together using an adhesive. Alternatively, the face insert 1404, the gasket 1430, and the perimeter ledge 1432 may be bonded using techniques such as welding, brazing, swaging, or mechanical fastening all without departing from the scope and content of the present invention so long as the face insert 1404 is not directly bonded to the perimeter ledge 1432 itself. Adhesive bonding may be preferred in embodiments where subjecting the gasket 1430 to heat causes adverse effects to the material of the gasket 1430.

Figure 23:
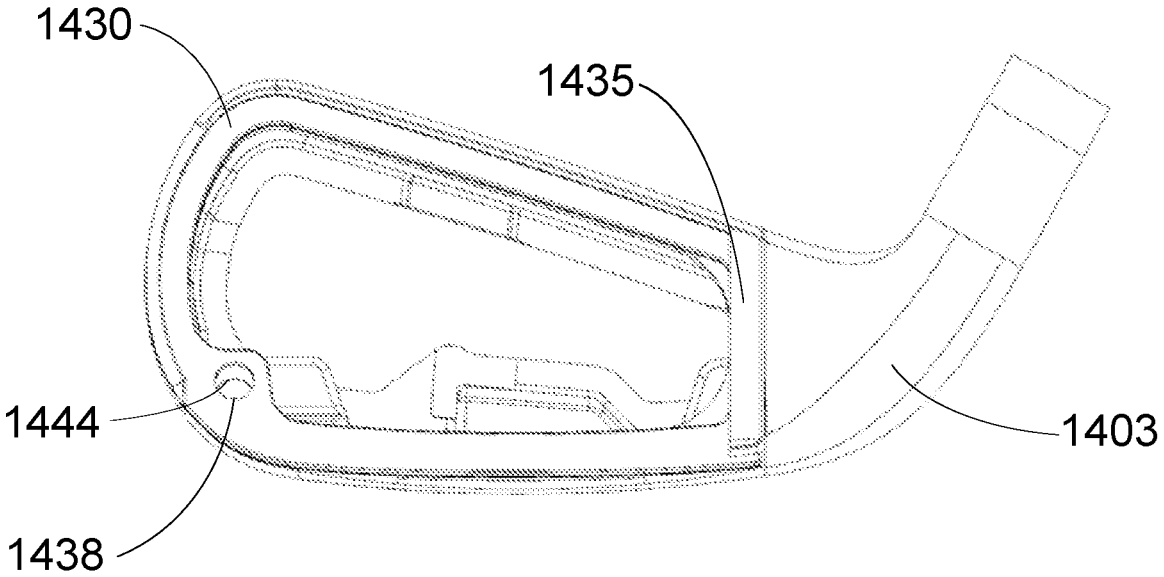
FIG. 23 of the accompanying drawings shows a front view of a golf club head in accordance with an embodiment of the present invention.
Figure 24:
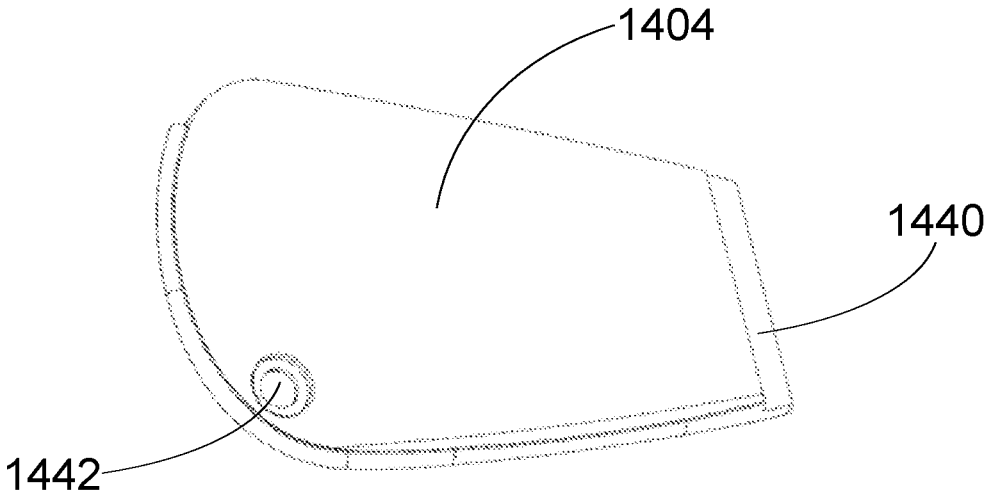
FIG. 24 of the accompanying drawings shows a perspective view of a face insert in accordance with an embodiment of the present invention.
Figure 25:
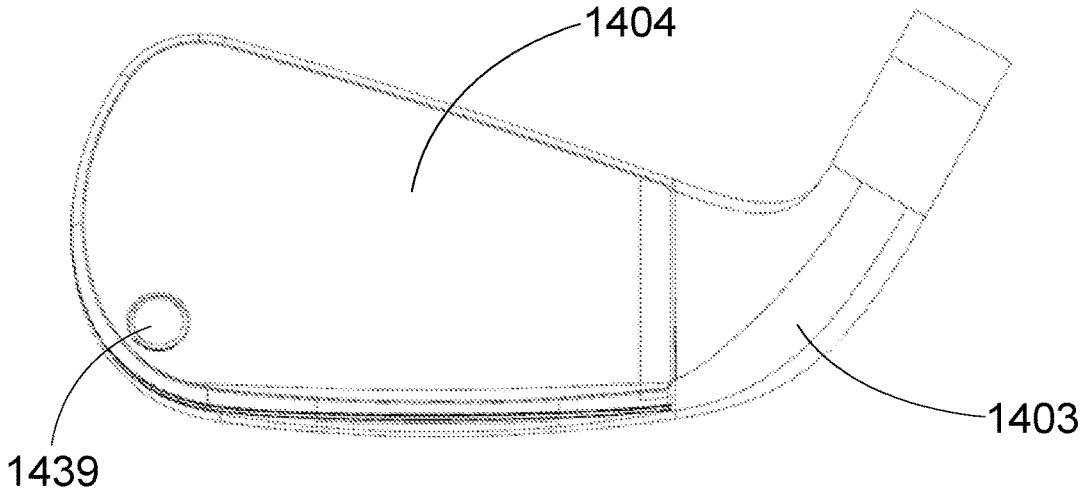
FIG. 25 of the accompanying drawings shows a front view of a golf club head in accordance with an embodiment of the present invention.
Figure 26:
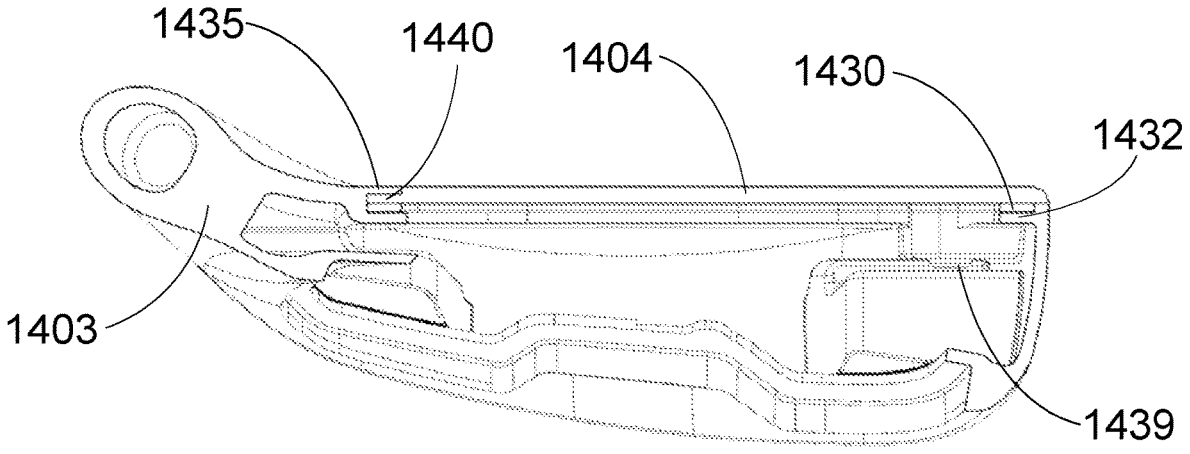
FIG. 26 of the accompanying drawings shows a top-down cross-sectional view of a golf club head in accordance with an embodiment of the present invention.

FIGS. 23-26 show an alternative embodiment of the golf club head 1400, wherein the face insert 1404, the gasket 1430, and the perimeter ledge 1432 are bonded together by mechanical fastening. As shown in FIG. 23, the body portion 1403 may include a protrusion 1435 which overhangs a heelward portion of the perimeter ledge 1432. The perimeter ledge 1432 may include an aperture 1444 at a location near the sole and the toc portion of the golf club head 1400. The aperture 1444 may include internal threads. The gasket 1430 may include a bore 1438, wherein the bore 1438 aligns with the aperture 1444 in the perimeter ledge 1432 when the gasket 1430 is positioned on the perimeter ledge 1432. FIG. 24 shows the face insert 1404 having a recessed tab 1440 configured to fit beneath the protrusion 1435 of the body portion 1403. Additionally, the face insert 1404 may include a recessed aperture 1442 configured to align with the bore 1438 in the gasket 1430 and the aperture 1444 in the perimeter ledge 1432. As shown in FIGS. 25 and 26, a fastener 1439 may be inserted through the recessed aperture 1442 in the face insert 1404, the bore 1438 in the gasket 1430, and the aperture 1444 in the perimeter ledge 1432 to secure the face insert 1404, the gasket 1430, and the perimeter ledge 1432 together. Bonding techniques such as gluing, welding, brazing, or swaging may be used in addition to the mechanical fastening shown in FIGS. 23-26 to further secure the face insert 1404, the gasket 1430, and the perimeter ledge 1432 together.

It should also be noted that although the thickness and height of the gasket 1430 is the same for the upper portion of the gasket 1430 and the lower portion of the gasket 1430, the thickness and height of the gasket could be different from one another without departing from the scope and content of the present invention. In one exemplary embodiment, the upper portion of the gasket 1430 could be thinner while the lower portion of the gasket 1430 could be thicker, to help the face insert 1404 deflect more upward upon impact with a golf ball to produce higher launch and spin without departing from the scope and content of the present invention. If the thickness of the gasket 1430 is to be manipulated, the depth of the perimeter ledge 1432 may be adjusted accordingly to create a seamless flush look of the golf club head 1400 in its resting neutral position.

It should be noted that most of the embodiments discussed here aims to create a releasable hosel hole cover, however, all of these embodiments may include glue to make the hosel hole cover stay within the hosel hole, removing the ability to remove the hosel hoe cover without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a body portion, said body portion comprising:

a rear portion, a front portion opposite said rear portion, a heel portion including a hosel configured to connect to a shaft, a toe portion opposite said heel portion, a topline, and a sole opposite said topline;

a face insert configured to be attached to said front portion of said body portion;

a gasket located between said body portion and said face insert;

a pocket on an interior of said body portion; and a perimeter ledge in said pocket, wherein said gasket includes a first portion made of a first material and a second portion made of a second material, wherein said first material is different than said second material, wherein said perimeter ledge is located proximate said heel portion, said sole, said toe portion, said topline, and said front portion of said body portion, wherein said first portion of said gasket abuts said perimeter ledge, and wherein said second portion of said gasket abuts said perimeter ledge.

2. The golf club head of claim 1, wherein said face insert is made of titanium or steel, and wherein said first material is softer than said face insert.

3. The golf club head of claim 2, wherein said second material is a composite material or a polymeric material.

4. The golf club head of claim 2, wherein said second material has a modulus of elasticity between about 2 MPa and 120 GPa.

5. The golf club head of claim 1, wherein said face insert, said gasket, and said perimeter ledge are bonded together using an adhesive.

6. The golf club head of claim 1, further comprising a recessed aperture in said face insert, a bore in said gasket, and an aperture in said perimeter ledge, wherein a fastener is configured to be inserted through said recessed aperture, said bore, and said aperture to secure said face insert, said gasket, and said perimeter ledge together.

7. The golf club head of claim 6, wherein said body portion includes a protrusion which overhangs a heelward portion of said perimeter ledge, and wherein said face insert includes a recessed tab configured to fit beneath said protrusion.

8. The golf club head of claim 1, wherein said gasket has a thickness measured in a front-to-rear direction between about 0.2 mm and 4 mm.

9. A golf club head comprising:

a body portion, said body portion comprising:

a rear portion, a front portion opposite said rear portion, a heel portion including a hosel configured to connect to a shaft, a toe portion opposite said heel portion, a topline, a sole opposite said topline, a pocket on an interior of said body portion, and a perimeter ledge in said pocket, wherein said perimeter ledge is located proximate said heel portion, said sole, said toe portion, said topline, and said front portion of said body portion;

a face insert configured to be attached to said body portion at said front portion of said body portion, said face insert including a plurality of scorelines extending in a heel-to-toe direction on an exterior surface; and a gasket located between said perimeter ledge and said face insert and having a perimeter portion which abuts said perimeter ledge proximate said heel portion, said sole, said toe portion, and said topline, wherein said face insert is made from a first material, wherein a first portion along said perimeter portion of said gasket is made from a second material and a second portion along said perimeter portion of said gasket is made from a third material, wherein said third material is different than said first material and said second material, wherein a lower portion of said face insert and a lower portion of said gasket form a portion of said sole of said golf club head.

10. The golf club head of claim 9, wherein said second material is softer than said first material.

11. The golf club head of claim 10, wherein said second material has a modulus of elasticity between about 2 MPa and 120 GPa.

12. The golf club head of claim 11, wherein said gasket has a thickness measured in a front-to-rear direction between about 0.2 mm and 4 mm.

13. The golf club head of claim 9, wherein said gasket further comprises a bridge portion that spans said pocket in a topline-to-sole direction creating a first void in said gasket located in a direction toeward of said bridge portion and a second void in said gasket located in a direction heelward of said bridge portion, and wherein said bridge portion overlaps a face center of said face insert.

14. A golf club head comprising:

a body portion, said body portion comprising:

a rear portion, a front portion opposite said rear portion, a heel portion including a hosel configured to connect to a shaft, a toe portion opposite said heel portion, a topline, a sole opposite said topline, a pocket on an interior of said body portion, and a perimeter ledge in said pocket, wherein said perimeter ledge is located proximate said heel portion, said sole, said toe portion, said topline, and said front portion of said body portion;

a face insert configured to be attached to said body portion at said front portion of said body portion, said face insert including a plurality of scorelines extending in a heel-to-toe direction on an exterior surface; and a gasket located between said perimeter ledge and said face insert and having a perimeter portion which abuts said perimeter ledge proximate said heel portion, said sole, said toe portion, and said topline, wherein said face insert is made from a first material, wherein a first portion along said perimeter portion of said gasket is made from a second material and a second portion along said perimeter portion of said gasket is made from a third material, wherein said third material is different than said first material and said second material, wherein said gasket further comprises a bridge portion that spans said pocket in a heel-to-toe direction creating a first void in said gasket located in a direction below said bridge portion towards said sole and a second void in said gasket located in a direction above of said bridge portion towards said topline.

15. The golf club head of claim 9, wherein said gasket spans an entirety of said pocket.

16. The golf club head of claim 9, wherein said body portion includes a protrusion which overhangs a heelward portion of said perimeter ledge, and wherein said face insert includes a recessed tab configured to fit beneath said protrusion.

17. The golf club head of claim 9, wherein said second material forms a topline region of said gasket and said third material forms a sole region of said gasket.

18. The golf club head of claim 9, wherein said second material forms a heel region of said gasket and said third material forms a toe region of said gasket.

* * * * *